US011407604B2

(12) United States Patent
Miyagawa

(10) Patent No.: US 11,407,604 B2
(45) Date of Patent: Aug. 9, 2022

(54) SHEET SUCTION DEVICE, SHEET CONVEYOR, PRINTER, AND SUCTION AREA SWITCHING DEVICE

(71) Applicant: Hiroaki Miyagawa, Ibaraki (JP)

(72) Inventor: Hiroaki Miyagawa, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/148,662

(22) Filed: Jan. 14, 2021

(65) Prior Publication Data

US 2021/0237994 A1 Aug. 5, 2021

(30) Foreign Application Priority Data

Jan. 31, 2020 (JP) ..... JP2020-014535

(51) Int. Cl.
*B65H 5/22* (2006.01)

(52) U.S. Cl.
CPC ..... *B65H 5/222* (2013.01)

(58) Field of Classification Search
CPC .. B65H 5/222; B65H 5/226; B65H 2406/332; B65H 2406/361; B65H 2406/3612; B65H 2406/362; B65H 2406/3622; B65H 2406/3632; B65H 2406/33; B65H 2406/331; B65H 2406/412; B41J 13/226; B41F 21/102
See application file for complete search history.

(56) References Cited

U.S. PATENT DOCUMENTS

| | | | | |
|---|---|---|---|---|
| 8,177,231 | B2 * | 5/2012 | Fukui | B65H 27/00 271/276 |
| 9,315,331 | B2 * | 4/2016 | Gieser | B65G 29/00 |
| 9,561,671 | B1 * | 2/2017 | Herrmann | B41J 13/226 |
| 9,796,546 | B1 * | 10/2017 | LeFevre | B41J 11/007 |
| 2016/0368287 | A1 * | 12/2016 | Dolz | B41J 2/01 |
| 2019/0283992 | A1 * | 9/2019 | Maeyama | B65H 5/12 |
| 2020/0039772 | A1 | 2/2020 | Miyagawa | |

FOREIGN PATENT DOCUMENTS

| | | | | |
|---|---|---|---|---|
| DE | 2109237 | A1 * | 9/1972 | B65H 3/10 |
| JP | 2013-240997 | | 12/2013 | |
| JP | 2013-241272 | | 12/2013 | |
| JP | 2020-019637 | | 2/2020 | |

* cited by examiner

*Primary Examiner* — Luis A Gonzalez
(74) *Attorney, Agent, or Firm* — Harness, Dickey & Pierce, P.L.C.

(57) ABSTRACT

A sheet suction device includes a sheet bearer having a plurality of suction holes on a plurality of bearing areas, a rotational portion having a plurality of holes that is connectable to the plurality of suction holes, a suction unit configured to suck air via the plurality of holes of the rotational portion. The sheet bearer bears a plurality of sheets on the plurality of bearing areas of the circumferential surface of the sheet bearer and rotates. The rotational portion rotates in a same cycle of the sheet bearer. The sheet suction device further includes a switching unit that switches combinations of whether or not to suck the air among the plurality of bearing areas of the sheet bearer according to a phase of rotation of the sheet bearer or the rotational portion.

11 Claims, 26 Drawing Sheets

SHEET SUCTION DEVICE, SHEET CONVEYOR, PRINTER, AND SUCTION AREA SWITCHING DEVICE

CROSS-REFERENCE TO RELATED APPLICATION

This patent application is based on and claims priority pursuant to 35 U.S.C. § 119(a) to Japanese Patent Application No. 2020-014535, filed on Jan. 31, 2020, in the Japan Patent Office, the entire disclosure of which is hereby incorporated by reference herein.

BACKGROUND

Technical Field

Embodiments of the present disclosure relate to a sheet suction device, a sheet conveyor, a printer, and a suction area switching device.

Description of the Related Art

There is known a printer that prints on a sheet while a sheet conveyor conveys the sheet borne on a rotating member such as a drum. The sheet conveyor sucks and attracts the sheet onto the circumferential surface of the drum and conveys the sheet borne on the drum.

SUMMARY

Embodiments of the present disclosure describe an improved sheet suction device that includes a sheet bearer having a plurality of suction holes on a plurality of bearing areas, a rotational portion having a plurality of holes that is connectable to the plurality of suction holes, a suction unit configured to suck air via the plurality of holes of the rotational portion. The sheet bearer bears a plurality of sheets on the plurality of bearing areas of the circumferential surface of the sheet bearer and rotates. The rotational portion rotates in a same cycle of the sheet bearer. The sheet suction device further includes a switching unit that switches combinations of whether or not to suck the air among the plurality of bearing areas of the sheet bearer according to a phase of rotation of the sheet bearer or the rotational portion.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
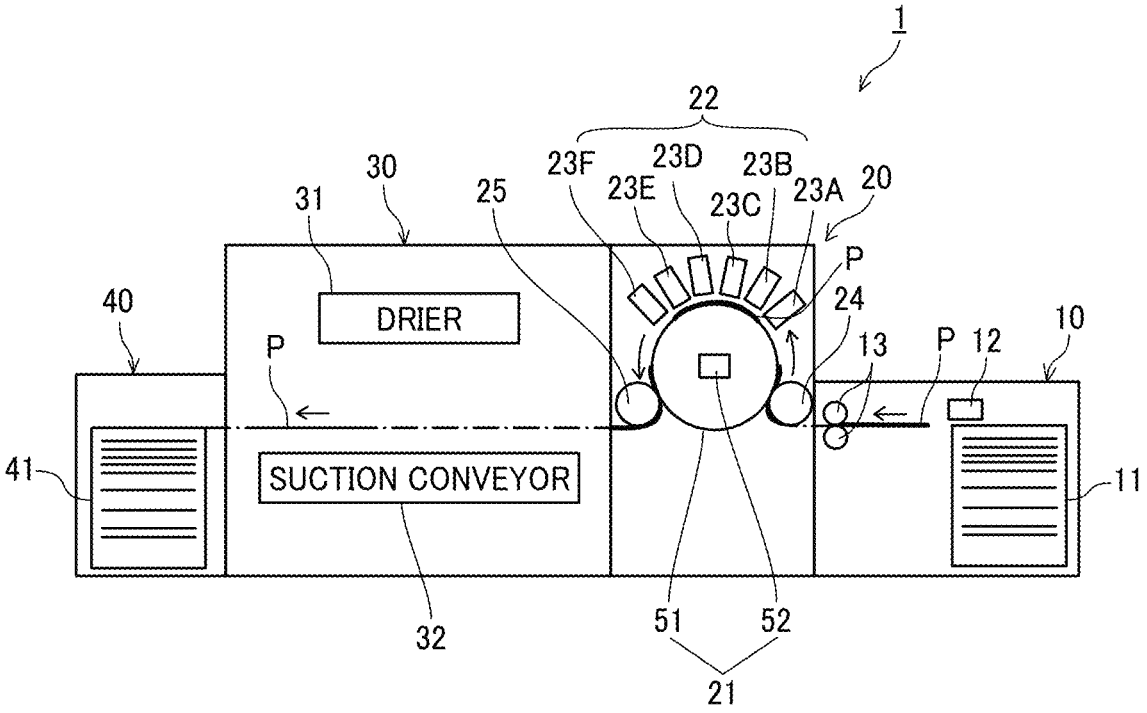
FIG. 1 is a schematic view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that suffixes, such as A, B, C, a1, a2, a3, and the like attached to each reference numeral indicate the positions of elements, such as holes, grooves, suction ports, paths, and valves indicated thereby. These elements may have different shape, size, and the like, but the suffixes may be omitted unless particularly distinguished or when the elements are collectively referred to.

A comparative sheet conveyor includes a drum to suck and convey a sheet. A plurality of suction holes is provided on the entire circumferential surface of a support surface of the drum to support the sheet. The sheet conveyor further includes three suction areas to suck the entire surface of the sheet, a plurality of suction portions that divides each suction area into a plurality of areas, a switching unit between the plurality of suction portions and a negative pressure source, and a controller. The switching unit switches the connection of the negative pressure source to each of the plurality of suction portions. The controller individually controls suction of each of the plurality of suction portions via the switching unit.

However, with such a configuration, when the sheet is conveyed while being borne on one or two of the three suction areas of the drum, air is sucked in the other suction areas on which a sheet is not borne, thereby sucking foreign substances such as mist. As a result, clogging of the suction holes causing a suction failure may occur.

The present disclosure has been made in view of the above situation, and an object of the present disclosure is to reduce suction of foreign substances such as mist in the suction areas on which a sheet is not borne.

Figure 2:
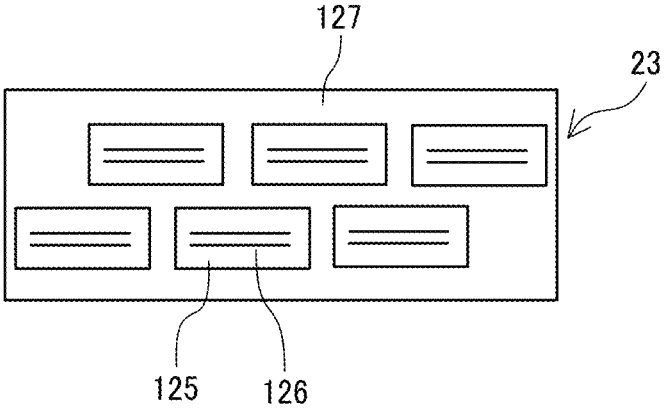
FIG. 2 is a plan view of a discharge unit of the printer illustrated in FIG. 1.

Embodiments of the present disclosure are described below with reference to the accompanying drawings. A first embodiment of the present disclosure is described with reference to FIGS. 1 and 2. FIG. 1 is a schematic view of a printer 1 according to the present embodiment. FIG. 2 is a plan view illustrating an example of a discharge unit 23 (one of discharge units 23A to 23F) of the printer 1 illustrated in FIG. 1.

The printer 1 includes a loading device 10, a printing device 20, a drying device 30, and an ejection device 40. In the printer 1, the printing device 20 applies a liquid to a sheet P carried from the loading device 10, thereby performing printing, and the drying device 30 dries the liquid adhering to the sheet P, after which the sheet P is ejected to the ejection device 40.

The loading device 10 includes a loading tray 11 on which a plurality of sheets P are stacked, a feeder 12 to separate and feed the sheets P one by one from the loading tray 11, and a registration roller pair 13 to feed the sheets P to the printing device 20. Any feeder such as a device using a roller or a device using air suction may be used as the feeder 12. The sheet P fed from the loading tray 11 by the feeder 12 is delivered to the printing device 20 by the registration roller pair 13 being driven at a predetermined timing after a leading end of the sheet P reaches the registration roller pair 13.

The printing device 20 includes a sheet conveyor 21 to convey the sheet P. The sheet conveyor 21 includes a sheet suction device 50 (see FIG. 3) including a drum 51, a suction unit 52, and the like. The drum 51 serves as a sheet bearer that bears the sheet P on a circumferential surface thereof and rotates. The suction unit 52 generates a suction force on the circumferential surface of the drum 51. The printing device 20 further includes a liquid discharge section 22 that discharges a liquid toward the sheet P borne on the drum 51 of the sheet conveyor 21.

The printing device 20 further includes a transfer cylinder 24 that receives the sheet P delivered from the loading device 10 and transfers the sheet P to the drum 51 and a transfer cylinder 25 that transfers the sheet P conveyed by the drum 51 to the drying device 30. The transfer cylinder 24 includes a sheet gripper to grip a leading end of the sheet P conveyed from the loading device 10 to the printing device 20. The sheet P thus gripped is conveyed as the transfer cylinder 24 rotates. The transfer cylinder 24 forwards the sheet P to the drum 51 at a position opposite the drum 51.

Similarly, the drum 51 includes a sheet gripper 106 (see FIG. 4) on the surface thereof, and the leading end of the sheet P is gripped by the sheet gripper 106 of the drum 51. The drum 51 includes a plurality of suction holes 112 (see FIGS. 3 and 4) dispersed on the surface thereof. The suction unit 52 sucks air (or generates a suction airflow) through the plurality of suction holes 112 of the drum 51 toward an interior of the drum 51. On the drum 51, the sheet gripper 106 grips the leading end of the sheet P transferred from the transfer cylinder 24, and the sheet P is attracted to the drum 51 by the suction airflow by the suction unit 52. As the drum 51 rotates, the sheet P is conveyed.

The liquid discharge section 22 includes discharge units 23 (23A to 23F). For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K). Further, the discharge units 23E and 23F are used to discharge the liquid of any one of Y. M. C. and K or a liquid of spot color such as white, gold, or silver. Furthermore, a discharge unit that discharges a treatment liquid such as a surface coating liquid may be provided.

The discharge unit 23 (each of the discharge units 23A to 23F) is a full line head type and includes a plurality of liquid discharge heads 125 arranged on a base 127. The liquid discharge head 125 includes nozzle rows 126 including a plurality of nozzles. The plurality of liquid discharge heads 125 is arranged, for example, as illustrated in FIG. 2. The discharge operation of the respective discharge units 23 of the liquid discharge section 22 is controlled by a drive signal corresponding to print data. When the sheet P carried by the drum 51 passes through a region facing the liquid discharge section 22, the respective color liquids are discharged from the discharge units 23, and an image corresponding to the print data is printed on the sheet P.

The drying device 30 includes a dryer 31 to dry the liquid adhering to the sheet P in the printing device 20 and a suction conveyor 32 to convey the sheet P conveyed from the printing device 20 while sucking the sheet P (i.e., suction conveyance). The sheet P conveyed from the printing device 20 is received by the suction conveyor 32, conveyed while passing through the dryer 31, and forwarded to the ejection device 40. When the sheet P passes through the dryer 31, the liquid on the sheet P is dried. Thus, a liquid component such as moisture in the liquid evaporates, and the colorant contained in the liquid is fixed on the sheet P. Additionally, curling of the sheet P is restrained.

The ejection device 40 includes an ejection tray 41 on which a plurality of sheets P is stacked. The plurality of sheets P conveyed from the drying device 30 is sequentially stacked and held on the ejection tray 41.

The printer 1 can further include, for example, a pretreatment device disposed upstream from the printing device 20, or a post-processing device (a finisher) disposed between the drying device 30 and the ejection device 40. The pretreatment device performs pretreatment on the sheet P. The post-processing device performs post-processing of the sheet P to which the liquid adheres.

For example, the pretreatment device coats the sheet P with a treatment liquid that reacts with the liquid to inhibit bleeding (a pre-coating process). For example, the post-processing device turns upside down the sheet P printed by the printing device 20 and again sends the sheet P to the printing device 20 for performing printing on both sides of the sheet P (a sheet reversal conveyance process). Alternatively, the post-processing device can bind together the plurality of sheets P.

Note that, in the present embodiment, the printing device 20 includes the liquid discharge section 22 including the discharge units 23 serving as an image forming unit to form an image on the sheet P. However, a printing device (image forming unit) employing other printing methods can be used instead of the discharge units 23.

Figure 3:
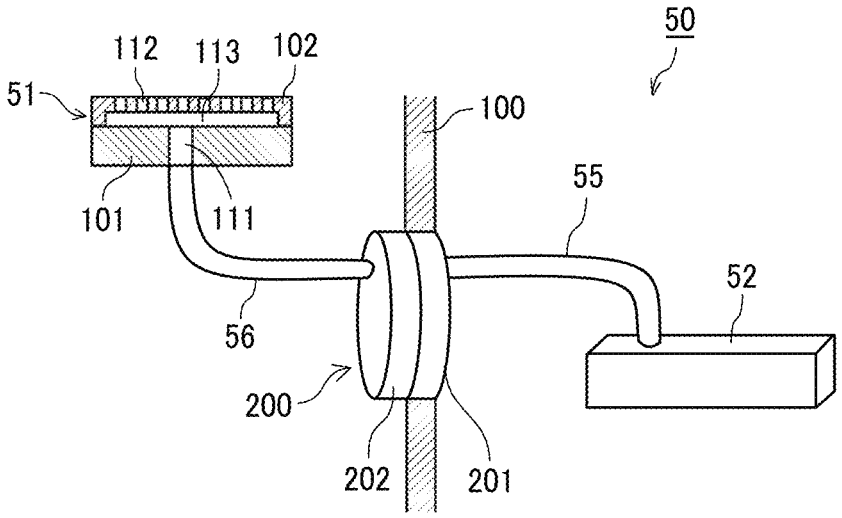
FIG. 3 is a schematic view illustrating a configuration of a sheet suction device according to the first embodiment of the present disclosure.

A sheet suction device 50 according to the first embodiment of the present disclosure is described with reference to FIG. 3. FIG. 3 is a schematic view illustrating a configuration of the sheet suction device 50. The sheet suction device 50 includes the drum 51 as a sheet bearer, the suction unit 52, and a rotary valve 200 as a suction area switching device disposed between the drum 51 and the suction unit 52. The suction unit 52 and the rotary valve 200 are communicated with each other via a hose (tube) 55, and the rotary valve 200 and the drum 51 are communicated with each other via a hose (tube) 56.

Figure 4:
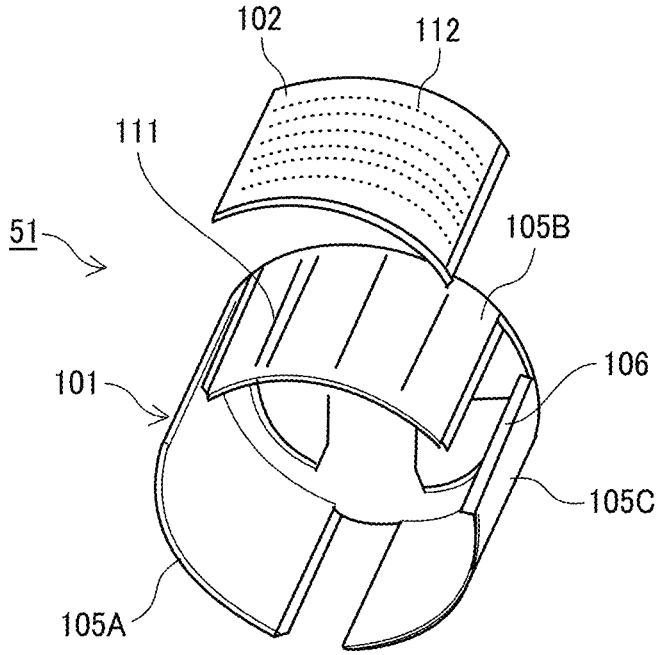
FIG. 4 is an exploded perspective view of a drum of the sheet suction device.
Figure 5:
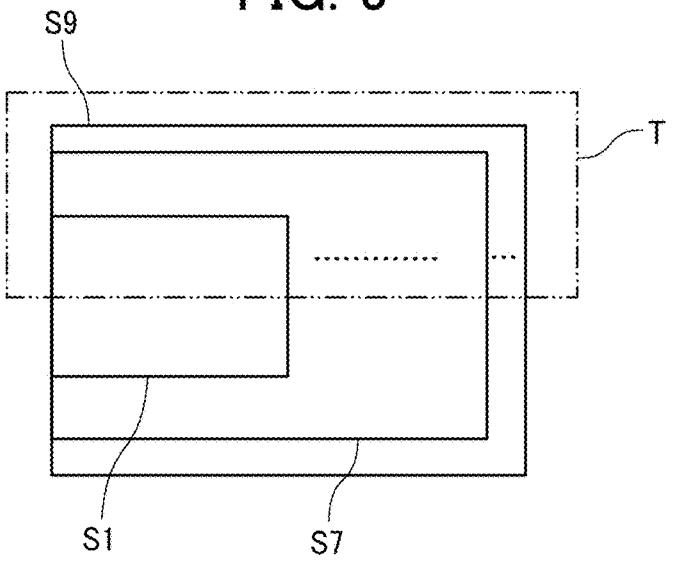
FIG. 5 is a plan view of sheet areas for explaining sheet sizes on one of bearing areas of the drum.
Figure 6:
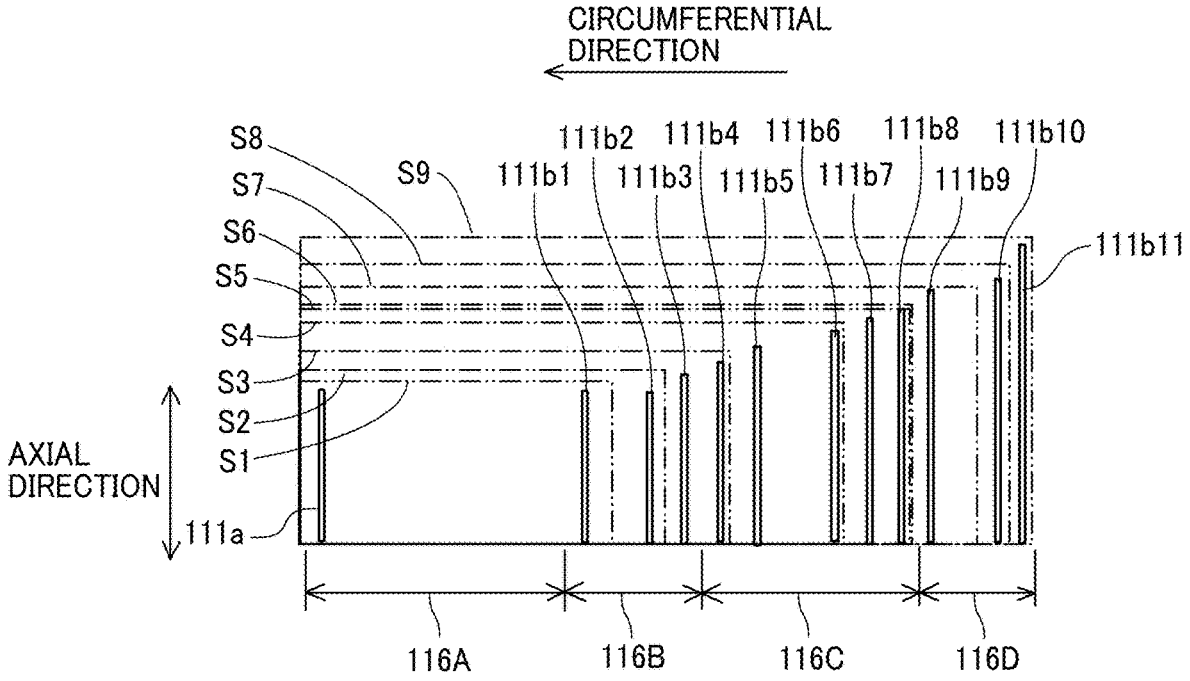
FIG. 6 is an enlarged plan view of a portion T in FIG. 5 for explaining the arrangement of suction ports of the drum and the sheet sizes in the circumferential direction of the drum.
Figure 7:
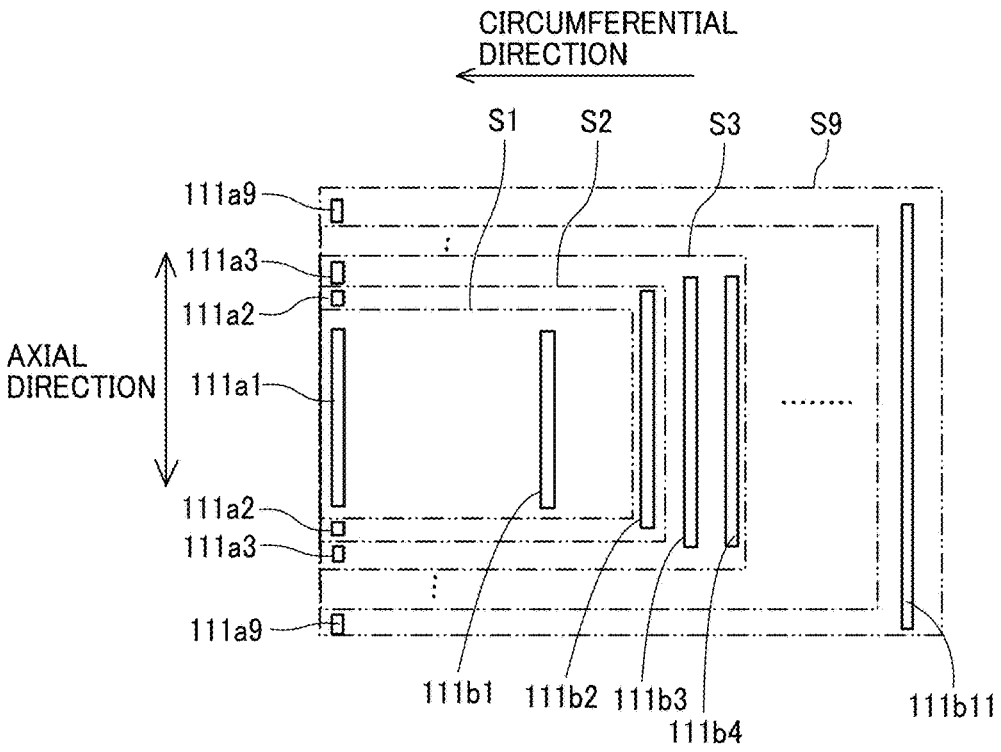
FIG. 7 is a plan view of the bearing area for explaining the arrangement of the suction ports and the sheet sizes in the axial and circumferential directions of the drum.
Figure 8:
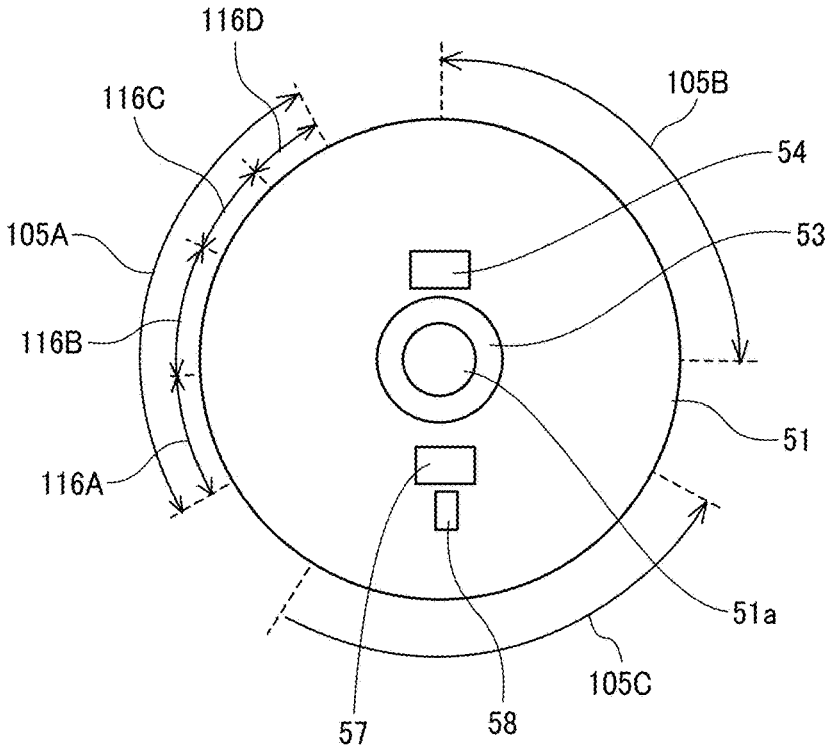
FIG. 8 is a schematic side view of the drum for explaining the bearing areas and divided areas thereof.

Next, the drum 51 is described with reference to FIGS. 4 to 7. FIG. 4 is an exploded perspective view of the drum 51. FIG. 5 is a plan view of sheet areas for explaining sheet sizes on one of bearing areas of the drum 51. FIG. 6 is an enlarged view of a portion T in FIG. 5 for explaining the arrangement of suction ports of the drum 51 and the sheet sizes in the circumferential direction of the drum 51. FIG. 7 is a plan view of the bearing area for explaining the arrangement of the suction ports and the sheet sizes in the axial and circumferential directions of the drum 51. FIG. 8 is a schematic side view of the drum 51 for explaining the bearing areas and divided areas thereof.

The drum 51 includes a drum body 101 and a suction plate 102. A sealing material such as a rubber sheet may be interposed between the suction plate 102 and the drum body 101. The drum 51 has three bearing areas 105 (105A to 105C) and can bear a plurality of sheets P in the circumferential direction thereof. As illustrated in FIG. 3, each bearing area 105 is constructed of the suction plate 102 and the drum body 101. The suction plate 102 includes the plurality of suction holes 112 and forms a chamber 113 with which each suction hole 112 communicates. The plurality of suction holes 112 is arranged in the axial and circumferential directions of the drum 51. The drum body 101 includes grooved suction ports 111 communicating with the chamber 113. The sheet gripper 106, which is simply illustrated in FIG. 4, is disposed at the leading end of the bearing area 105 in the direction of rotation of the drum 51 (hereinafter, referred to as a "rotation direction").

As illustrated in FIGS. 5 and 6, sheet areas S1 to S9 corresponding to a plurality of sheet sizes (9 sheet sizes in the present embodiment) are allocated to one bearing area 105, and 12 suction ports 111*a* (111*a*1 to 111*a*9) and 111*b*1 to 111*b*11 are arranged in the circumferential direction in the one bearing area 105. On the leading side of the bearing area 105 in the rotation direction, as illustrated in FIG. 7, the suction ports 111*a*1 to 111*a*9 are arranged in the axial direction corresponding to the sheet areas S1 to S9.

For example, the suction ports 111*a*1 and 111*b*1 are provided so as to communicate with a portion of the chamber 113 where the plurality of suction holes 112 corresponding to the sheet area S faces. The suction ports 111*a*2 and 111*b*2 are provided so as to communicate with a portion of the chamber 113 where the plurality of suction holes 112 corresponding to the sheet area S2 excluding the sheet area S1 faces. The suction ports 111*a*3, 111*b*3, and 111*b*4 are provided so as to communicate with a portion of the chamber 113 where the plurality of suction holes 112 corresponding to the sheet area S3 excluding the sheet areas S1 and S2 faces. The same applies to the other sheet areas S4 to S9.

Further, as illustrated in FIG. 8, one bearing area 105 is divided into a first range 116A, a second range 116B, a third range 116C, and a fourth range 116D from the leading side of the bearing area 105 in the circumferential direction (rotation direction). Here, as illustrated in FIG. 6, the first range 116A is allocated to the suction ports 1111*a* on the leading side of the bearing area 105 in the rotation direction of the drum 51, the second range 116B is allocated to the suction ports 111*b*1 to 111*b*3, the third range 116C is allocated to the suction ports 111*b*4 to 111*b*8, and the fourth range 116D is allocated to the suction ports 111*b*9 to 111*b*11. Therefore, the suction area can be switched by connecting the hoses 56 to the respective suction ports 111 (suction ports 111*a* and 111*b*) on the drum 51 and switching whether to generate negative pressure for the respective suction ports 111 (suction ports 111*a* and 111*b*).

With reference again to FIG. 3, the rotary valve 200 includes a rotational portion 202 and a switching unit 400 including a stationary portion 201. The rotational portion 202 is a rotator that rotates in the same cycle of (or together with) the drum 51. The stationary portion 201 is connected to the suction unit 52 and does not rotate together with the drum 51. The stationary portion 201 serves as a part of the switching unit 400 that switches whether or not to suck air in the bearing areas 105. The switching unit 400 is described later. As illustrated in FIG. 8, an encoder wheel 53 that rotates in synchronization with the drum 51 is attached to a rotation shaft 51*a* of the drum 51. Further, a feeler 58 that rotates in synchronization with the drum 51 is attached to the drum 51.

An encoder sensor 54 and a home position sensor 57 are attached to a frame 100 (see FIG. 3) of the printer 1. The encoder sensor 54 detects an amount of rotation of the encoder wheel 53, and the home position sensor 57 detects the feeler 58. The home position sensor 57 detects the feeler 58 once per one rotation of the drum 51 (i.e., one pulse) to detect the home position of the drum 51 in the rotation direction. The encoder sensor 54 detects the amount of rotation of the encoder wheel 53 to detect an amount of relative rotation of the drum 51 from the home position. A controller of the printer 1 combines the detection results of the two sensors (i.e., the encoder sensor 54 and the home position sensor 57) to detect an absolute phase of rotation of the drum 51 and the rotational portion 202 that rotates together with the drum 51.

The controller of the printer 1 switches the communication and non-communication between the suction holes 112 and the suction unit 52 based on a relative phase difference between the rotational portion 202 and the stationary portion 201, thereby controlling the timing of generating the negative pressure on the circumferential surface of the drum 51. In other words, the controller causes the switching unit 400 to switch combinations of whether or not to suck air among the plurality of bearing areas 105 of the drum 51 according to the phase of rotation of the drum 51 and the rotational portion 202. The relative phase difference is calculated from the detection results of the two sensors (i.e., the encoder sensor 54 and the home position sensor 57). Generally, a metal plate processed into a disk-shape is used for both the rotational portion 202 and the stationary portion 201.

Figure 9:
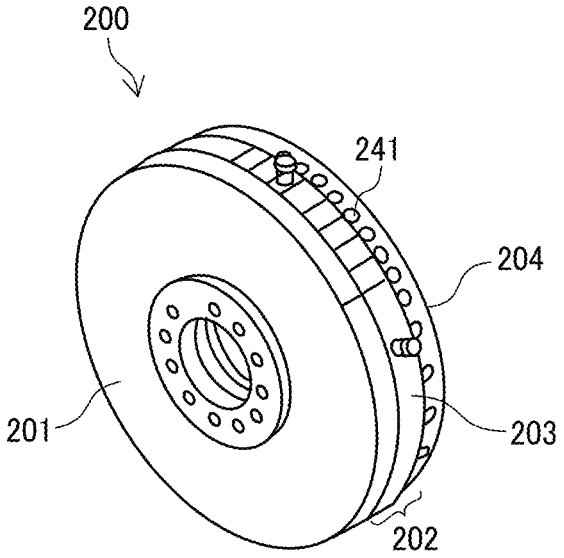
FIG. 9 is an exterior perspective view of a rotary valve according to the first embodiment of the present disclosure.
Figure 10:
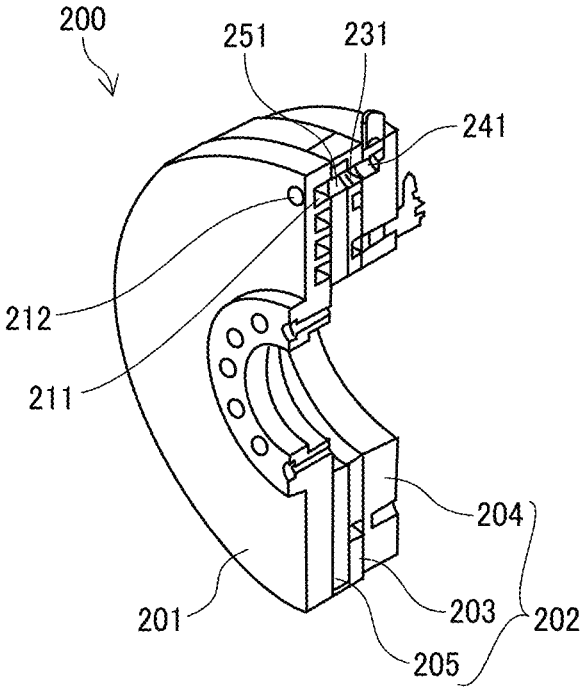
FIG. 10 is a cross-sectional perspective view of the rotary valve.
Figure 11:
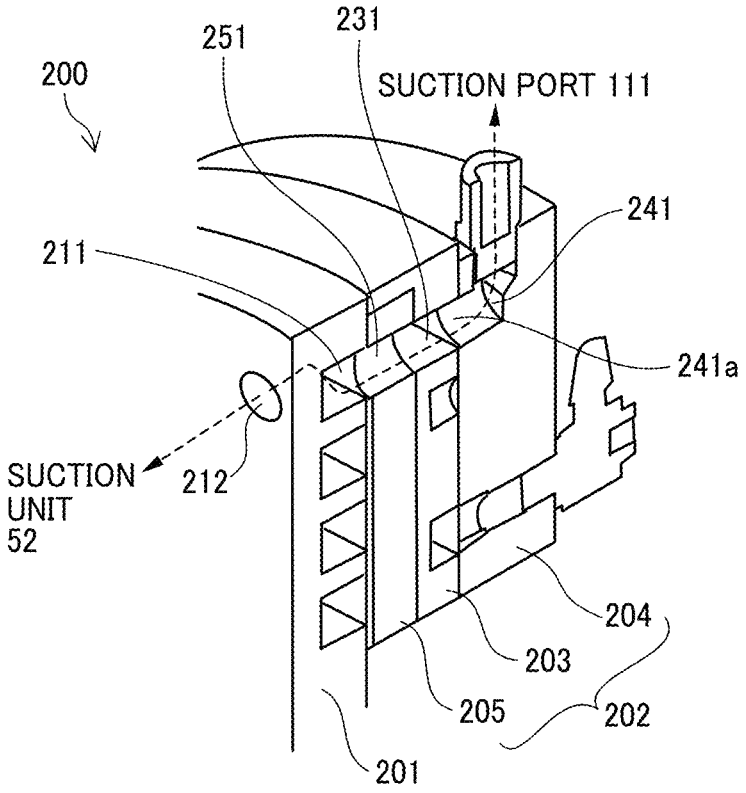
FIG. 11 is an enlarged cross-sectional perspective view of a part of the rotary valve.
Figure 12A:
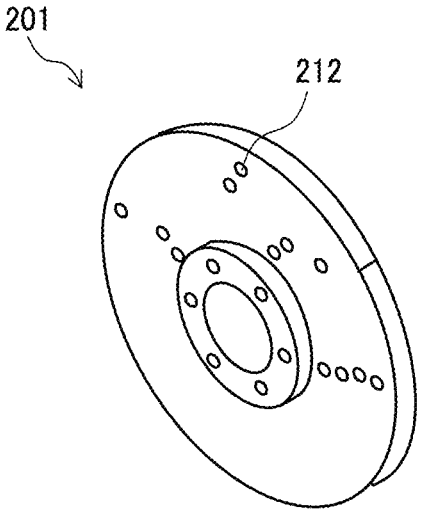
FIGS. 12A and 12B are perspective views of a stationary portion included in the rotary valve.
Figure 12B:
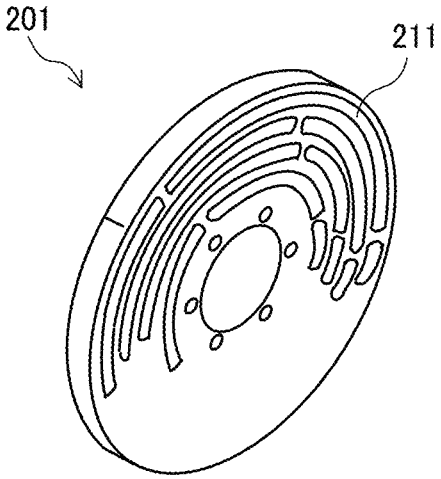
Figure 13:
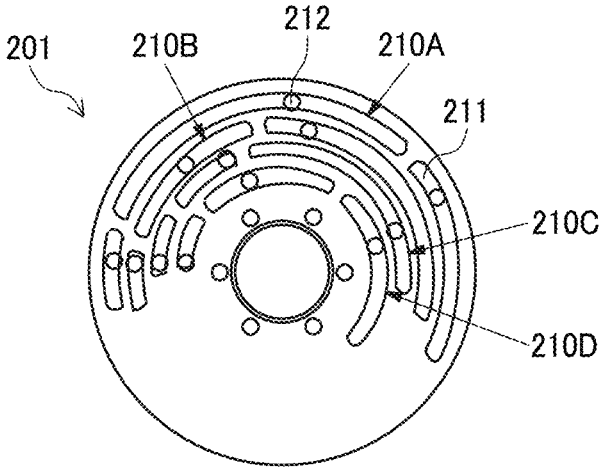
FIG. 13 is a side view of the stationary portion.
Figure 14A:
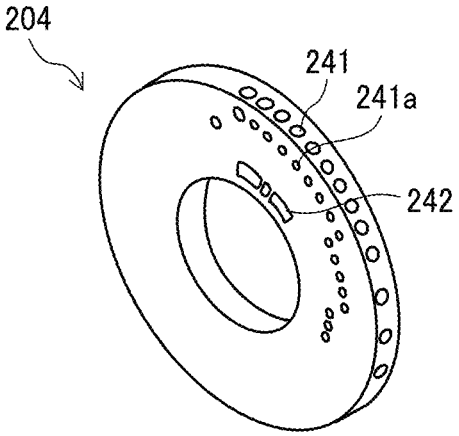
FIGS. 14A and 14B are perspective views of a second member included in the rotary valve.
Figure 14B:
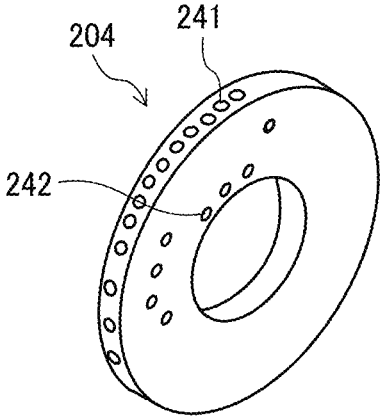
Figure 15:
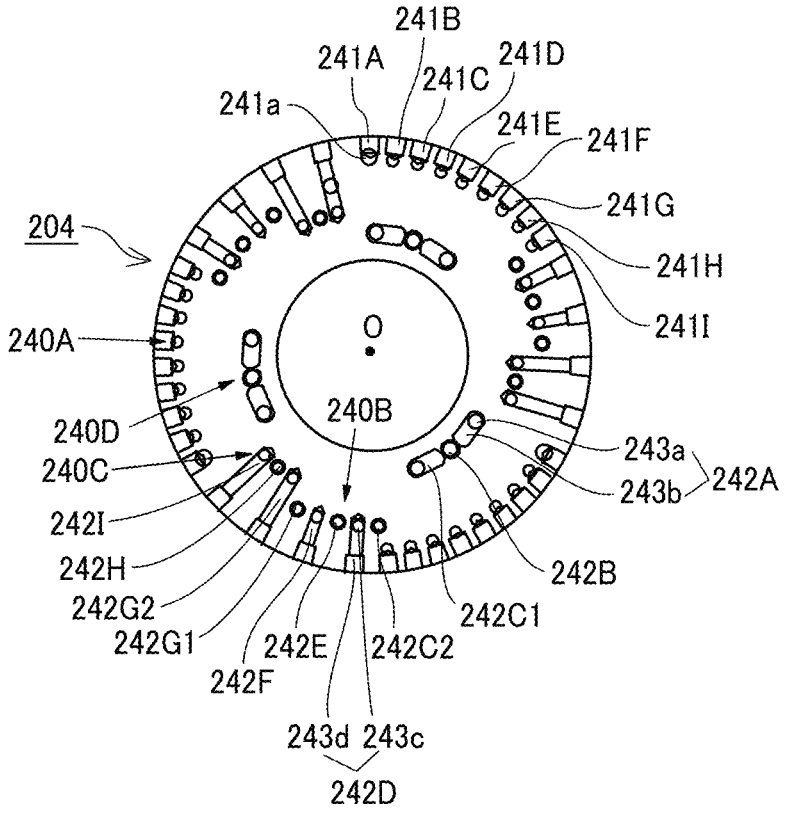
FIG. 15 is a side view of the second member.
Figure 16A:
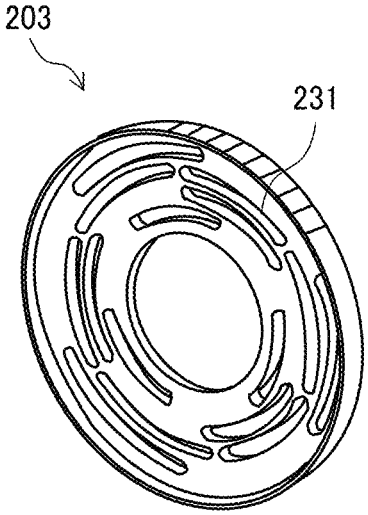
FIGS. 16A and 16B are perspective views of a first member included in the rotary valve.
Figure 16B:
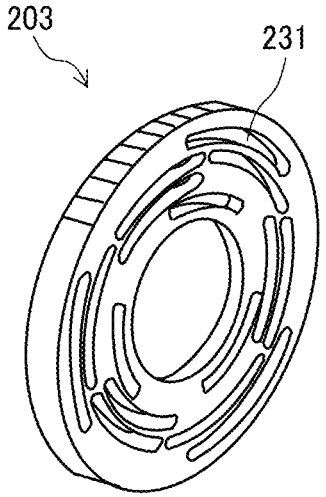
Figure 17:
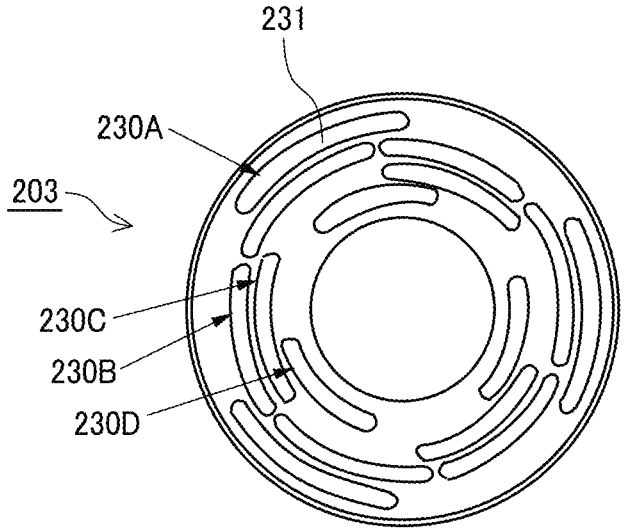
FIG. 17 is a side view of the first member.
Figure 18A:
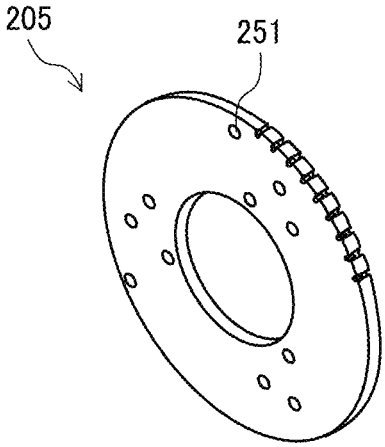
FIGS. 18A and 18B are perspective views of a third member included in the rotary valve.
Figure 18B:
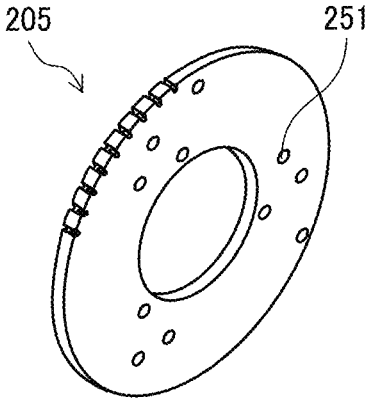
Figure 19:
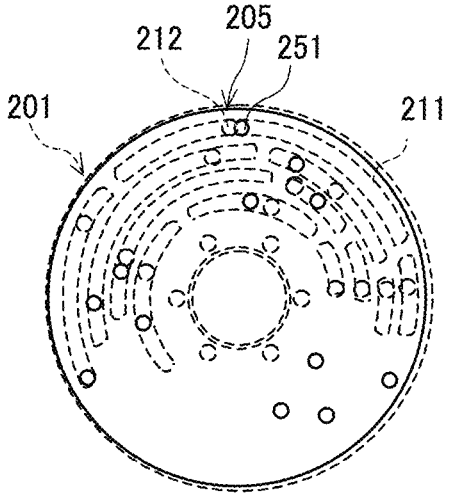
FIG. 19 is a side view of the third member overlaid on the stationary portion.

Next, the rotary valve 200 is described with reference to FIGS. 9 to 15. FIG. 9 is an exterior perspective view of the rotary valve 200. FIG. 10 is a cross-sectional perspective view of the rotary valve 200. FIG. 11 is an enlarged cross-sectional perspective view of a part of the rotary valve 200. FIGS. 12A and 12B are perspective views of the stationary portion 201 included in the rotary valve 200. FIG. 13 is a side view of the stationary portion 201. FIGS. 14A and 14B are perspective views of a second member 204 included in the rotary valve 200. FIG. 15 is a side view of the second member 204. FIGS. 16A and 16B are perspective views of a first member 203 included in the rotary valve 200. FIG. 17 is a side view of the first member 203. FIGS. 18A and 18B are schematic perspective views of a third member 205 included in the rotary valve 200. FIG. 19 is a side view of the third member 205 overlaid on the stationary portion 201.

As illustrated in FIG. 3, the stationary portion 201 of the rotary valve 200 is secured to the frame 100 of the printer 1. The frame 100 supports the drum 51, the transfer cylinder 24, and the discharge units 23. The stationary portion 201, the home position sensor 57, and the encoder sensor 54 may be secured to divided frames or brackets, respectively. As illustrated in FIGS. 12A and 12B, the stationary portion 201 has a plurality of rows of a plurality of grooves 211 arranged in the radial direction and divided into three in the circumferential direction on the side surface that slides with the rotational portion 202. Each groove 211 has a through hole 212 connected to the suction unit 52. Here, the rows of the grooves 211 located on the same concentric circles are referred to as groove rows 210A, 210B, 210C, 210D, respectively as illustrated in FIG. 13.

As illustrated in FIGS. 10 and 11, the rotational portion 202 of the rotary valve 200 includes the first member 203, the second member 204, and the third member 205 that are arranged in the order of the third member 205, the first member 203, and the second member 204 from the stationary portion 201. In the radial direction, the first member 203 has a shape that covers the outer circumferential surface of the third member 205, and the third member 205 fits into the first member 203.

As illustrated in FIGS. 14A to 15, the second member 204 has a plurality of holes 241 communicating with the suction ports 111 of the drum 51 on the circumferential surface of the disk-shape (here, nine holes 241A to 241I), and each hole 241 has an opening 241*a* disposed on the side surface in contact with the first member 203. The nine holes 241A to 241I arranged in the circumferential direction communicate with the nine suction ports 111*a* (111*a*1 to 111*a*9) arranged in the axial direction of the drum 51 and are connectable to the corresponding portions of the plurality of suction holes 112.

Further, the second member 204 has a plurality of types of holes 242 (242A to 242I) on the side surface of the disk-shape. Each of the holes 242A and 242C1 is constructed of a through hole 243*a* that penetrates the second member 204 in the axial direction and a groove 243*b* extending in the circumferential direction. The through hole 243*a* communicates with the groove 243*b*. Each of the holes 242B, 242C2, 242E, 242G1, and 242H is constructed of a through hole 243*a* that penetrates the second member 204 in the axial direction. Each of the holes 242D, 242F, 242G2, and 242I is constructed of a non-through hole 243*c* that does not penetrate the second member 204 in the axial direction and a hole 243*d* that extends in the radial direction from the non-through hole 243*c*. These holes 242 also communicates with the suction ports 111 and are connectable to the corresponding portions of the plurality of suction holes 112. As illustrated in FIG. 15, the pluralities of holes 241 and 242 are provided corresponding to the respective bearing areas 105A, 105B, and 105C, but in FIGS. 14A and 14B, the illustration is simplified and the holes 241 and 242 in one bearing area 105 are depicted.

As illustrated in FIGS. 16A to 17, the first member 203 has through grooves 231 along the circumferential direction on the side surface of the disk-shape, corresponding to each bearing area 105. The grooves 231 are arranged at four locations on the concentric circles from the outer circumference toward the center in the radial direction, and the rows of the grooves 231 located on the same concentric circles are referred to as groove rows 230A, 230B, 230C, 230D, respectively as illustrated in FIG. 17.

With reference again to FIG. 15, the rows of the openings 241*a* and the holes 242 of the second member 204 corresponding to the groove rows 230A to 230D of the first member 203 are referred to as hole rows 240A to 240D from the outer circumference toward the center, respectively. In each row, the openings 241*a* and the holes 242 are arranged in the circumferential direction of the second member 204. In the second member 204, the hole 242C1 belonging to the hole row 240D and the hole 242C2 belonging to the hole row 240B are two or more holes 242 that simultaneously communicate with the suction unit 52 via the first member 203 by the rotation of a unit rotation amount of the first member 203.

The holes 242C1 and 242C2, which are the two or more holes 242 that simultaneously communicate with the suction unit 52, are disposed at different distances from a rotation center O of the first member 203. In other words, the two holes 242C1 and 242C2, which communicate at the same time, belong to the different hole rows 240D and 240B among the plurality of hole rows 240 arranged in the radial direction of the second member 204, respectively.

Similarly, in the second member 204, the hole 242G1 belonging to the hole row 240B and the hole 242G2 belonging to the hole row 240C are two or more holes 242 that simultaneously communicate with the suction unit 52 via the first member 203 by the rotation of the unit rotation amount of the first member 203. That is, the holes 242G1 and 242G2, which are the two or more holes 242 that simultaneously communicate with the suction unit 52, are disposed at different distances from the rotation center O of the first member 203. In other words, the two holes 242G1 and 242G2, which communicate at the same time, belong to the different hole rows 240B and 240C among the plurality of hole rows 240 arranged in the radial direction of the second member 204, respectively.

In this way, the two holes 242C1 and 242C2 or the two holes 242G1 and 242G2 that are simultaneously communicate by the rotation of the unit rotation amount are provided. One of the two holes is selected according to the size of the sheet P to be used, and the rest that is not selected is closed by a plug. This configuration facilitates the adaptation to the size of the sheet P according to a destination.

As illustrated in FIG. 19, the third member 205 has through holes 251 that penetrate the disk-shape thereof and connect the grooves 211 of the stationary portion 201 and the grooves 231 of the first member 203. That is, the grooves 211 of the stationary portion 201 switches connection between the suction unit 52 and the through holes 251 of the third member 205 of the rotational portion 202. The first member 203, the second member 204, and the third member 205 included in the rotational portion 202 rotate together with the drum 51 when the sheet P is conveyed.

When the suction area is switched, the first member 203 is rotated relative to the second member 204 and the third member 205. The second member 204 and the third member 205 rotate together. As the first member 203 is rotated, the number of holes 242 of the second member 204 communicating with the grooves 231 of the first member 203 is changed, thereby changing the connection of the suction path. Accordingly, the suction area can be switched according to the size of the sheet P.

Figure 20:
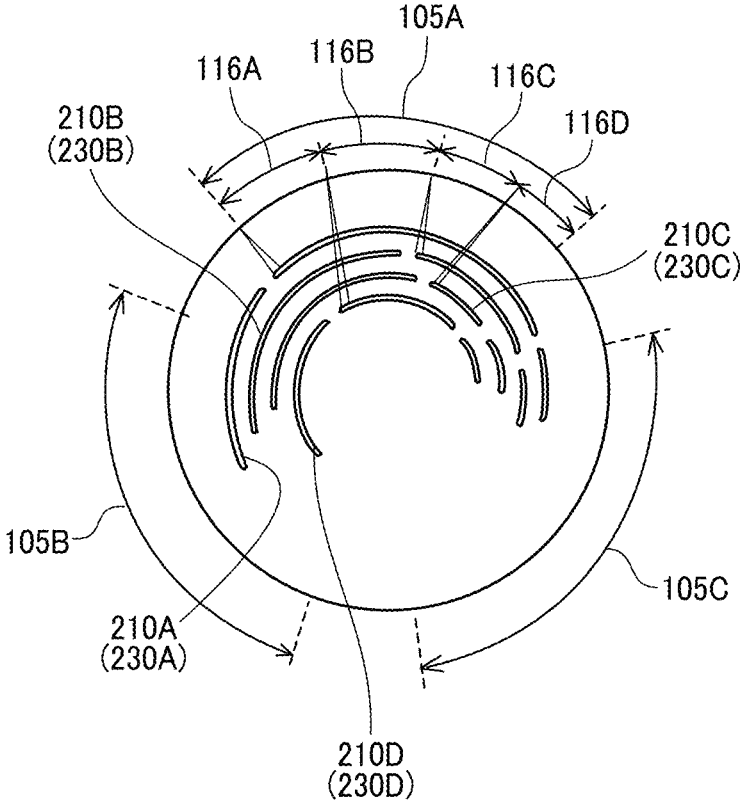
FIG. 20 is a schematic view for explaining allocation of grooves of the stationary portion to the bearing area.

The allocation of grooves 211 of the stationary portion 201 to the bearing areas 105 is described below with reference to FIG. 20. FIG. 20 is a schematic view for explaining the allocation. As described above, the circumferential surface of the drum 51 is divided into three bearing areas 105 (105A to 105C). One bearing area 105 is divided into the four ranges. i.e., the first range 116A, the second range 116B, the third range 116C, and the fourth range 116D.

The outermost groove row 210A of the stationary portion 201 is allocated to the first range 116A, and the groove row 230A of the first member 203 switches between communication and non-communication with the suction port 111 of the first range 116A. Further, the groove row 210D of the stationary portion 201 is allocated to the second range 116B, and the groove row 230D of the first member 203 switches between communication and non-communication with the suction port 111 of the second range 116B. Similarly, the groove row 210B of the stationary portion 201 is allocated to the third range 116C, and the groove row 230B of the first member 203 switches between communication and non-communication with the suction port 111 of the third range 116C. The groove row 210C of the stationary portion 201 is allocated to the fourth range 116D, and the groove row 230C of the first member 203 switches between communication and non-communication with the suction port 111 of the fourth range 116D.

Figure 21A:
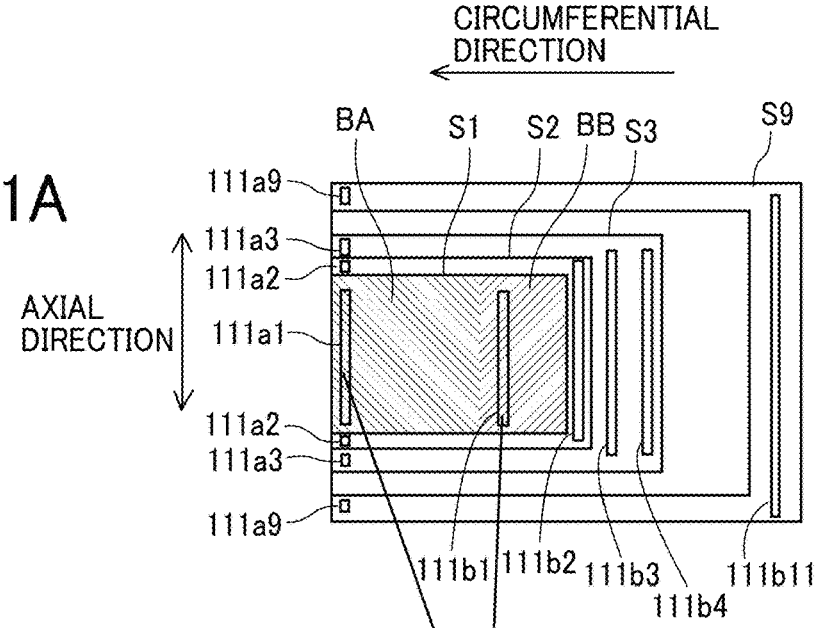
FIGS. 21A to 21C are schematic views for explaining switching of suction area (size switching) by relative rotation of the first member and the second member.
Figure 21B:
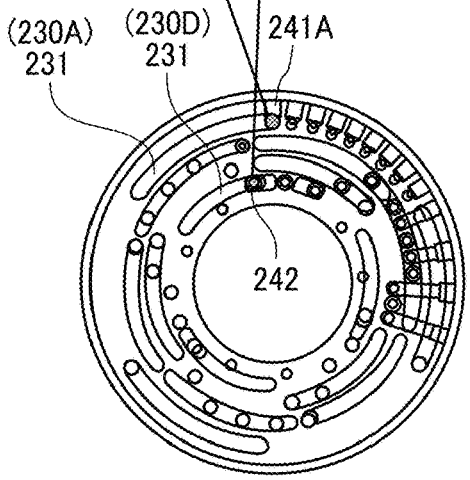
Figure 21C:
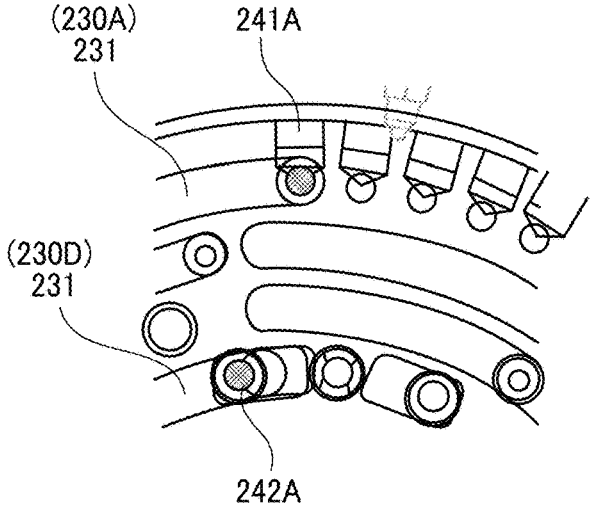
Figure 22A:
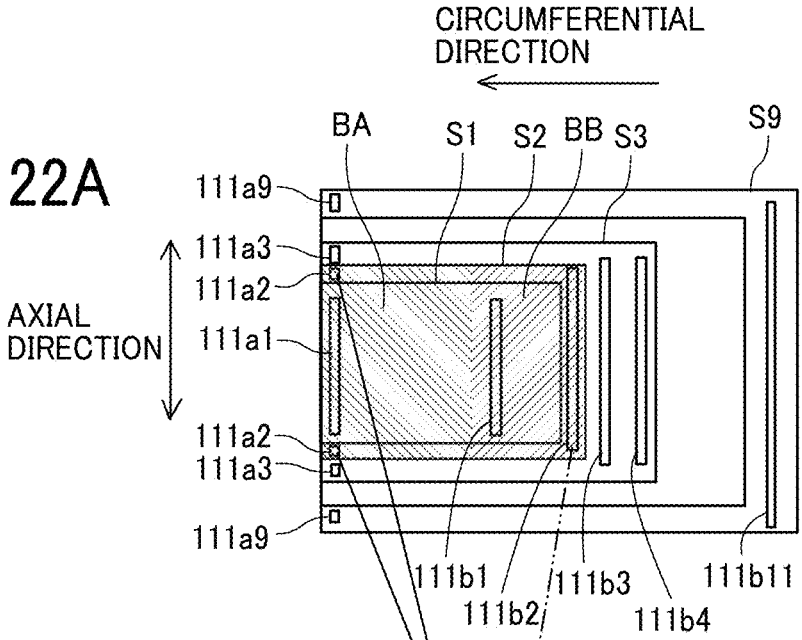
FIGS. 22A to 22C are schematic views for explaining the switching of suction area (size switching)
Figure 22B:
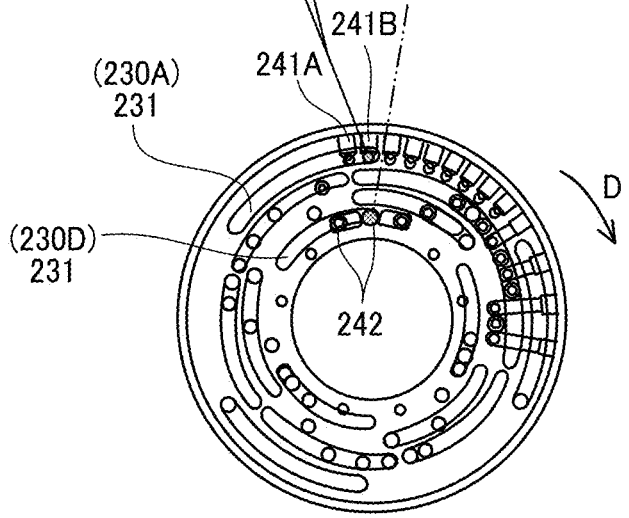
Figure 22C:
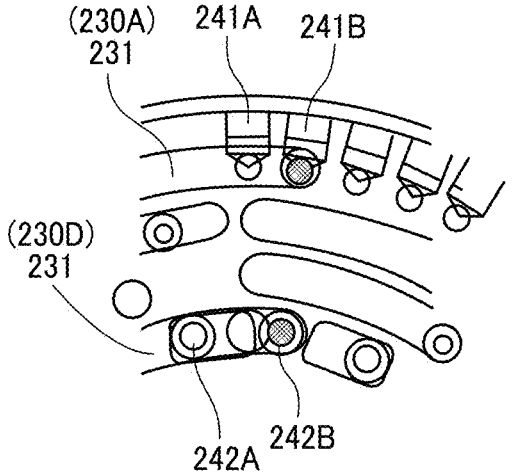
Figure 23C:
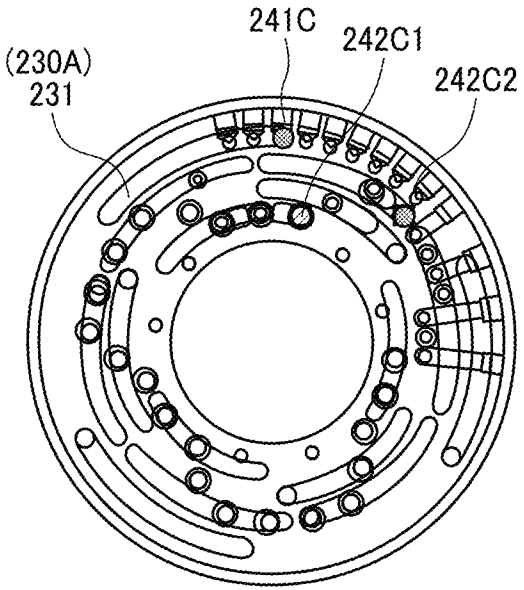
FIGS. 23A to 23C are transparent side views of the first member and the second member for explaining transition states when the suction area is switched in nine steps.
Figure 23B:
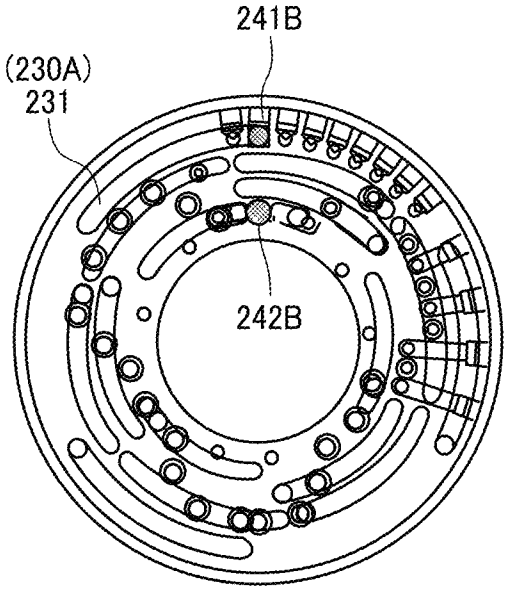
Figure 23A:
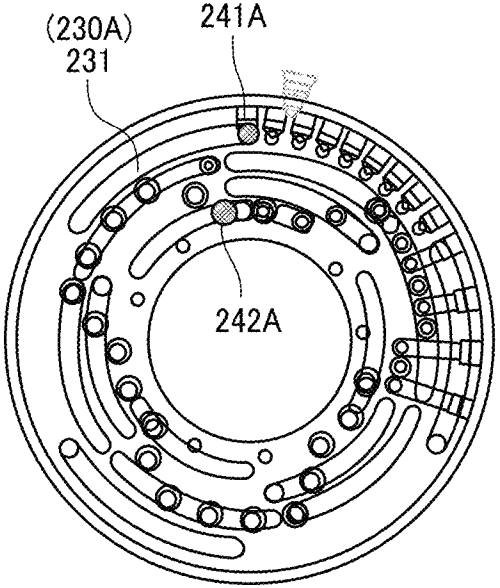
Figure 24C:
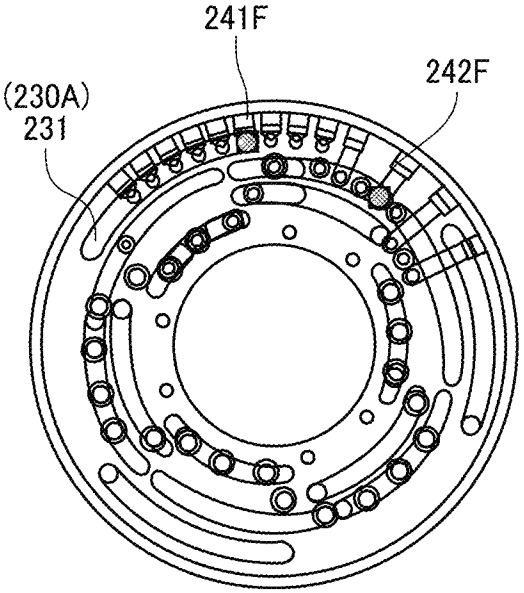
FIGS. 24A to 24C are transparent side views of the first member and the second member for explaining the next transition states following the transition state in FIG. 23C.
Figure 24B:
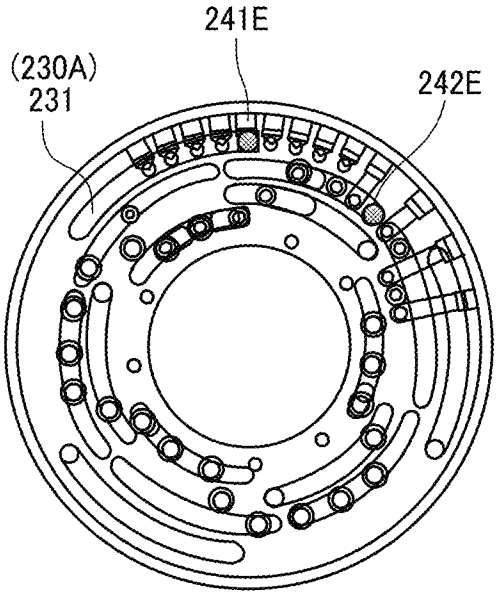
Figure 24A:
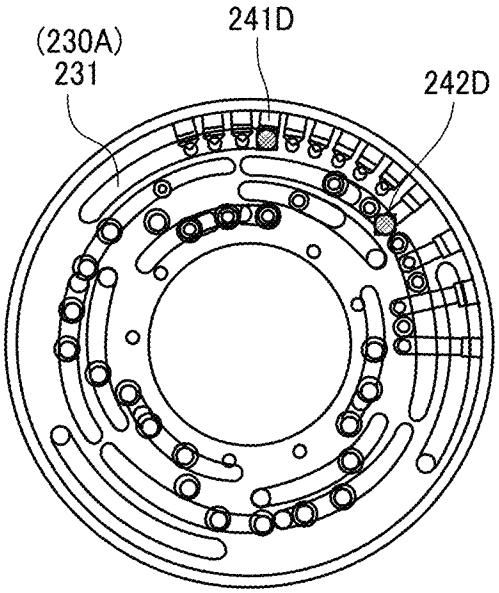
Figure 25A:
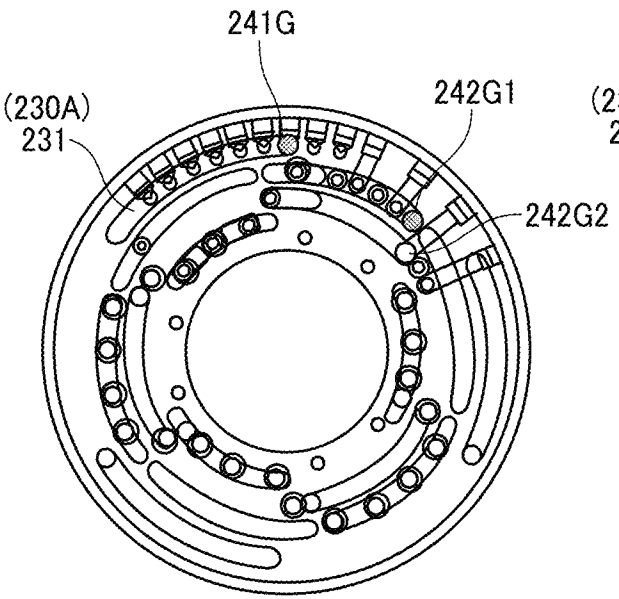
FIGS. 25A to 25C are transparent side views of the first member and the second member for explaining the next transition states following the transition state in FIG. 24C.
Figure 25B:
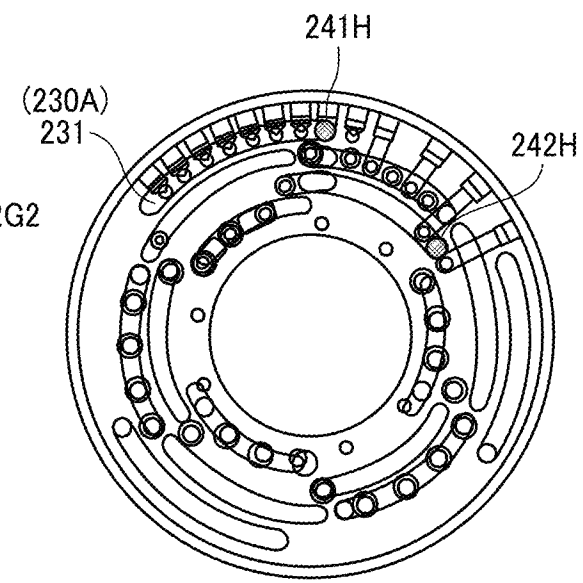
Figure 25C:
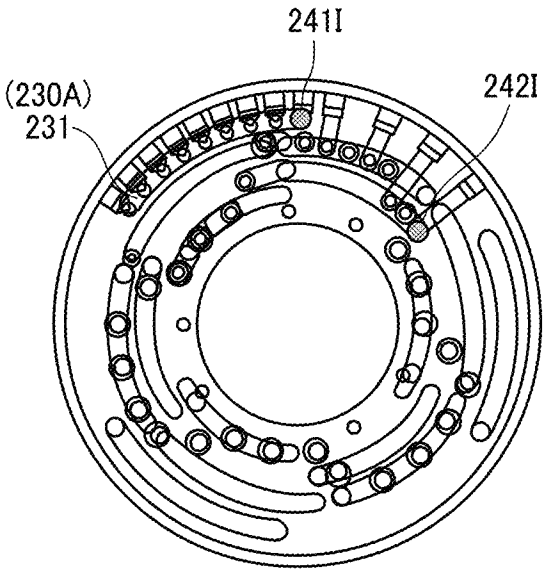

Next, the switching of the suction area (size switching) by the relative rotation of the first member 203 and the second member 204 is described with reference to FIGS. 21A to 22C. FIGS. 21A to 22C are schematic views for explaining the switching of the suction area. FIGS. 21A and 22A are top views illustrating the size of the sheet P and the suction ports 111 on the drum 51. FIGS. 21B and 22B are side views illustrating the first member 203 and the second member 204 transparently. FIGS. 21C and 22C are enlarged views of the first member 203 and the second member 204 illustrated in FIGS. 21B and 22B.

As described above, the nine holes 241A to 241I provided in the circumferential direction of the second member 204 communicate with the nine suction ports 111*a* (111*a*1 to 111*a*9). Therefore, the number of the suction ports 111*a* (111*a*1 to 111*a*9) communicating with the groove 231 of the groove row 230A of the first member 203 via the holes 241 (the openings 241*a*) of the second member 204 is switched, thereby switching the size of the suction area in the axial direction perpendicular to the circumferential direction of the drum 51. That is, the number of the holes 241 (the openings 241*a*) of the second member 204 communicating with the grooves 231 of the first member 203 is switched, thereby switching the number of the suction holes 112 communicating with the suction unit 52. These suction holes 112 face the corresponding portions of the chamber 113 with which the suction ports 111*a* communicate.

Further, the holes 242A to 242I of the second member 204 communicate with the suction ports 111*b* (111*b*1 to 111*b*11) of the drum 51. Therefore, the number of the suction ports 111*b* (111*b*1 to 111*b*1) communicating with the grooves 231 of the groove rows 230B to 230D of the first member 203 via the holes 242 of the second member 204 is switched, thereby switching the size of the suction area in the circumferential direction of the drum 51. That is, the number of the holes 242 of the second member 204 communicating with the grooves 231 of the first member 203 is switched, thereby switching the number of the suction holes 112 communicating with the suction unit 52. These suction holes 112 face the corresponding portions of the chamber 113 with which the suction ports 111*b* communicate.

For example, as illustrated in FIGS. 21B and 21C, the relative position between the first member 203 and the second member 204 is set to a state in which the groove 231 of the groove row 230A of the first member 203 communicates with the hole 241A of the second member 204 and the groove 231 of the groove row 230D of the first member 203 communicates with the hole 242A of the second member 204. At this time, the suction unit 52 and the suction port 111*a*1 of the drum 51 communicate with each other, and the suction unit 52 and the suction port 111*b*1 of the drum 51 communicate with each other. As a result, as illustrated in FIG. 21A, the suction unit 52 sucks the sheet P through the suction holes 112 belonging to an area BA communicating with the suction port 111*a*1 and an area BB communicating with the suction port 111*b*1, thereby sucking the sheet P in the suction area for the sheet area S1.

From this state, for example, as illustrated in FIGS. 22B and 22C, the first member 203 is rotated with respect to the second member 204 in the direction indicated by arrow D. and the relative position between the first member 203 and the second member 204 is set to a state in which the groove 231 of the groove row 230A of the first member 203 communicates with the two holes 241A and 241B of the second member 204 and the groove 231 of the groove row 230D of the first member 203 communicates with the two holes 242A and 242B of the second member 204. Note that the circles shaded in black in FIGS. 22B and 22C indicate the newly communicated holes (i.e. the hole 241B and 242B). At this time, the suction unit 52 and the suction ports 111*a*1 and 111*a*2 of the drum 51 communicate with each other, and the suction unit 52 and the suction ports 111*b*1 and 111*b*2 of the drum 51 communicate with each other. As a result, as illustrated in FIG. 22A, the suction unit 52 sucks the sheet P through the suction holes 112 belonging to the area BA communicating with the suction ports 111*a*1 and 111*a*2, and the area BB communicating with the suction ports 111*b*1 and 111*b*2, thereby sucking the sheet P in the suction area for the sheet area S2 having the next size of the sheet area S1.

With the above configuration, the transition when the first member 203 is rotated to switch the relative position with the second member 204 in nine steps is illustrated in FIGS. 23A to 25C. FIGS. 23A to 25C are transparent side views of the first member 203 and the second member 204. Note that the relative position is the same in FIG. 23A and FIG. 21B, and the relative position is the same in FIG. 23B and FIG. 22B.

The holes 241 and 242 of the second member 204 are arranged so that two or three holes among the holes 241 and 242 additionally communicate with the grooves 231 of the first member 203 in one of the bearing areas 105 of the drum 51 each time the relative position is switched by one step. In the present embodiment, since the drum 51 has the three bearing areas 105, six or nine holes among the holes 241 and 242 additionally communicate with the grooves 231 of the first member 203 when the first member 203 is rotated by one step.

The number of holes that additionally communicates by one step is two or three so that the hole communicating with the groove can be selected according to the destination. For example, three suction ports 111*b* are allocated to the innermost groove row 230D and five suction ports 111*b* are allocated to the groove row 230C, or two suction ports 111*b* are allocated to the innermost groove row 230D and five suction ports 111*b* are allocated to the groove row 230C.

Figure 26:
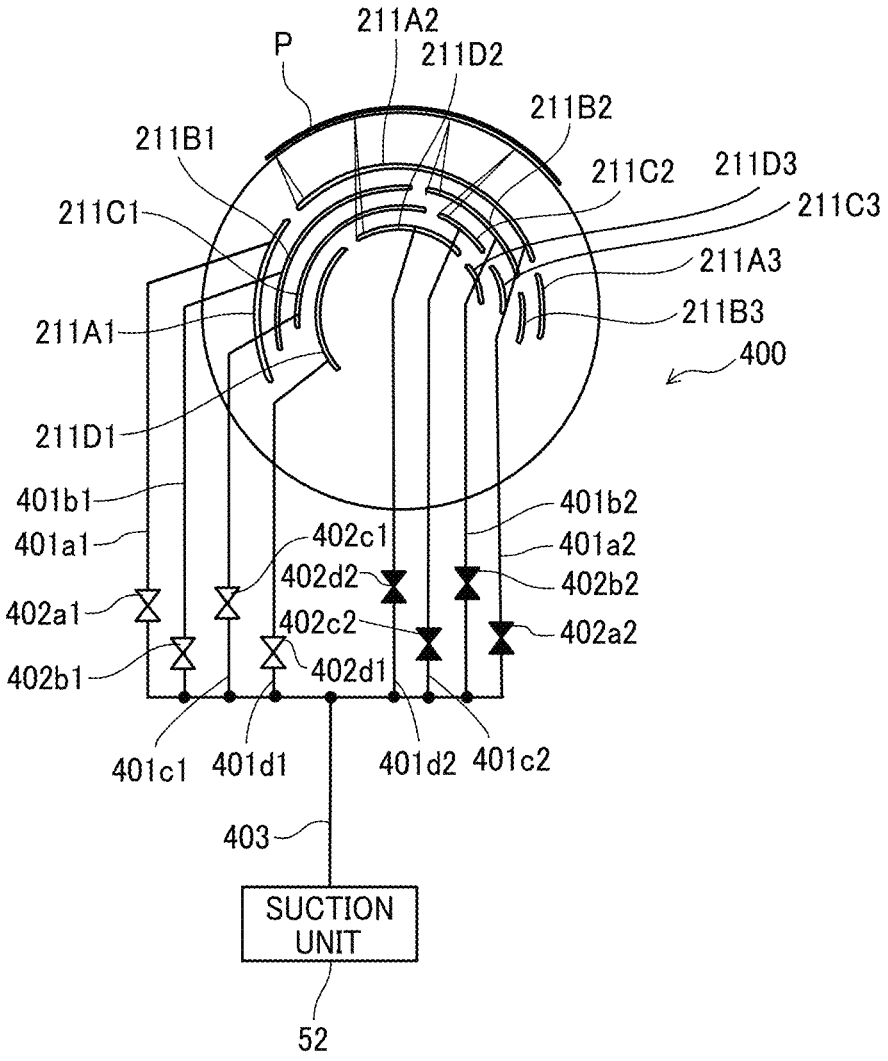
FIG. 26 is a schematic view of a switching unit that switches whether or not to suck air in the plurality of bearing areas of the drum according to a first embodiment of the present disclosure.
Figure 27:
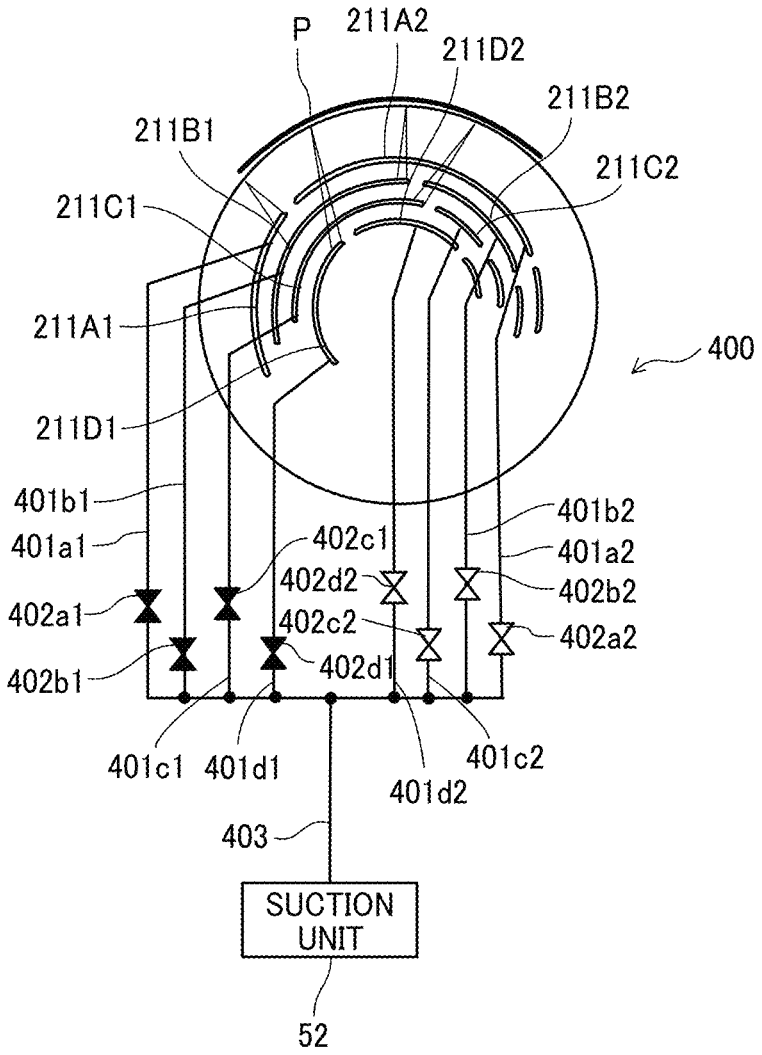
FIG. 27 is a schematic view of the switching unit in a state switched from a state illustrated in FIG. 26 according to the first embodiment.

Next, with reference to FIGS. 26 and 27, a description is given of the switching unit 400 that switches whether or not to suck air in the plurality of bearing areas 105 of the drum 51. FIGS. 26 and 27 are schematic views of the switching unit 400.

The switching unit 400 includes a stationary portion 201 and a plurality of valves 402 (402*a*1, 402*b*1, 402*c*1, and 402*d*1, and 402*a*2, 402*b*2, 402*c*2, and 402*d*2). Hereinafter, a group of elements, such as paths, valves, grooves, and the like, having reference numerals with suffixes including a different alphabetic character and an identical numeral character is collectively indicated, for example, like the "valves 402*a*1 to 402*d*1" that mean the valves 402*a*1, 402*b*1, 402*cl*, and 402*d*1. Note that FIG. 26 illustrates only individual paths 401 (401*a*1 to 401*dl* and 401*a*2 to 401*d*2) connecting the two grooves 211 of the respective groove rows 210 of the stationary portion 201 and the corresponding valves 402.

The groove row 210A of the stationary portion 201 includes grooves 211A1 to 211A3. Similarly, the groove row 210B includes grooves 211B1 to 211B3, the groove row 210C includes grooves 211C1 to 211C3, and the groove row 210D includes grooves 211D1 to 211D3. Each of the grooves 211A1, 211B1, 211C1, and 211D is connected to the suction unit 52 via a common path 403 and the individual paths 401*a*1 to 401*dl*. In the individual paths 401*a*1 to 401*dl*, the valves 402 (402*a*1 to 402*dl*) that open and close between the grooves 211 A1, 211B1, 211C1, and 211D1 and the suction unit 52 are disposed. Each of the grooves 211A2, 211B2, 211C2, and 211D2 is connected to the suction unit 52 via the common path 403 and the individual paths 401*a*2 to 401*d*2. In the individual paths 401*a*2 to 401*d*2, the valves 402 (402*a*2 to 402*d*2) that open and close between the grooves 211A2, 211B2, 211C2, and 211D2 and the suction unit 52 are disposed. Note that the same applies to individual paths and valves corresponding to the grooves 211A3 to 211D3, but the individual paths and the valves are omitted for simplicity. Further, among the valves 402, the valves 402 illustrated in black is in an open state, and the valves 402 illustrated in white is in a closed state.

With such a configuration, for example, when the sheet P indicated by the solid line in FIG. 26 is sucked, the valves 402*a*2 to 402*d*2 are opened, and thereby the grooves 211A2 to 211D2 are connected to the suction unit 52. Thus, the suction is enabled. On the other hand, as the valves 402*a*1 to 402*d*1 are closed, the grooves 211A1 to 211D1 are not connected to the suction unit 52. Thus, the suction is disabled in the areas where the sheet P is not borne. When the drum 51 rotates and the sheet P reaches the position illustrated in FIG. 27, as illustrated in FIG. 27, the valves 402*a*1 to 402*d*1 are opened to enable the suction via the grooves 211A1 to 211D1, and the valves 402*a*2 to 402*d*2 are closed to disable the suction via the grooves 211A2 to 211D2. Accordingly, this configuration can prevent foreign substances such as mist from being sucked through the suction holes 112 on the bearing area 105 on which the sheet P is not borne.

Figure 28:
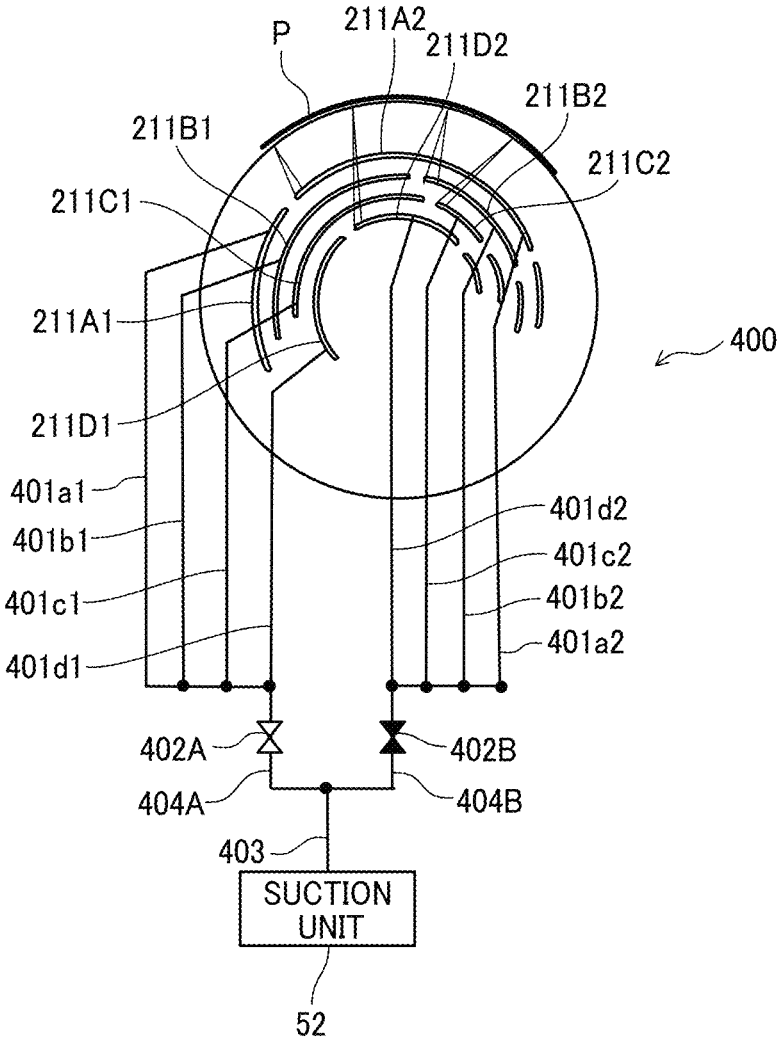
FIG. 28 is a schematic view of a switching unit that switches whether or not to suck air in the plurality of bearing areas of the drum according to a second embodiment.
Figure 29:
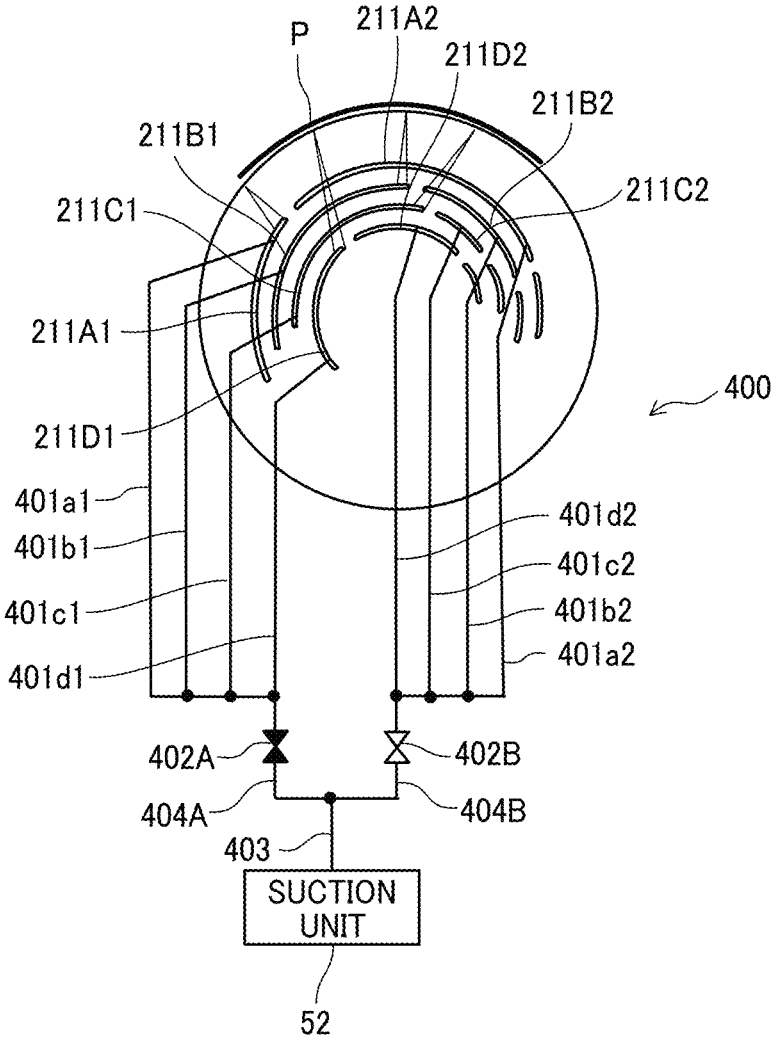
FIG. 29 is a schematic view of the switching unit in a state switched from a state illustrated in FIG. 28 according to the second embodiment.

Next, a second embodiment of the present disclosure is described with reference to FIGS. 28 and 29. FIGS. 28 and 29 are schematic views of a switching unit 400 that switches whether or not to suck air in the plurality of bearing areas 105 of the drum 51 according to the second embodiment. In the present embodiment, the individual paths 401*a*1 to 401*d*1 are collectively connected to a divided common path 404A, and the individual paths 401*a*2 to 401*d*2 are collectively connected to a divided common path 404B. Further, the divided common paths 404A and 404B are collectively connected to the common path 403. Common valves 402A and 402B are disposed in the divided common paths 404A and 404B, respectively.

In FIG. 28, the sheet P is borne in a state in which the common valve 402A is closed to disable the suction via the grooves 211A1 to 211D1 and the common valve 402B is opened to enable the suction via the grooves 211A2 to 211D2. When the drum 51 rotates and the sheet P reaches the position illustrated in FIG. 29, as illustrated in FIG. 29, the common valve 402A is opened to enable the suction via the grooves 211A1 to 211D1, and the common valve 402B is closed to disable the suction via the grooves 211A2 to 211D2.

With this configuration, foreign substances such as mist can be prevented from being sucked by disabling the suction in the areas on which the sheet P is not borne. In the present embodiment, since the common valves 402A and 402B are common to the grooves 211 (i.e., the grooves 211A1 to D1 and the grooves 211 A2 to D2) belonging to different groove rows 210A to 210D arranged in the radial direction, the number of valves 402 can be reduced. In other words, since whether or not to suck air in the plurality of bearing areas 105 is switched in units of each of the plurality of sheet P borne on the drum 51, the number of valves 402 can be reduced.

Figure 30:
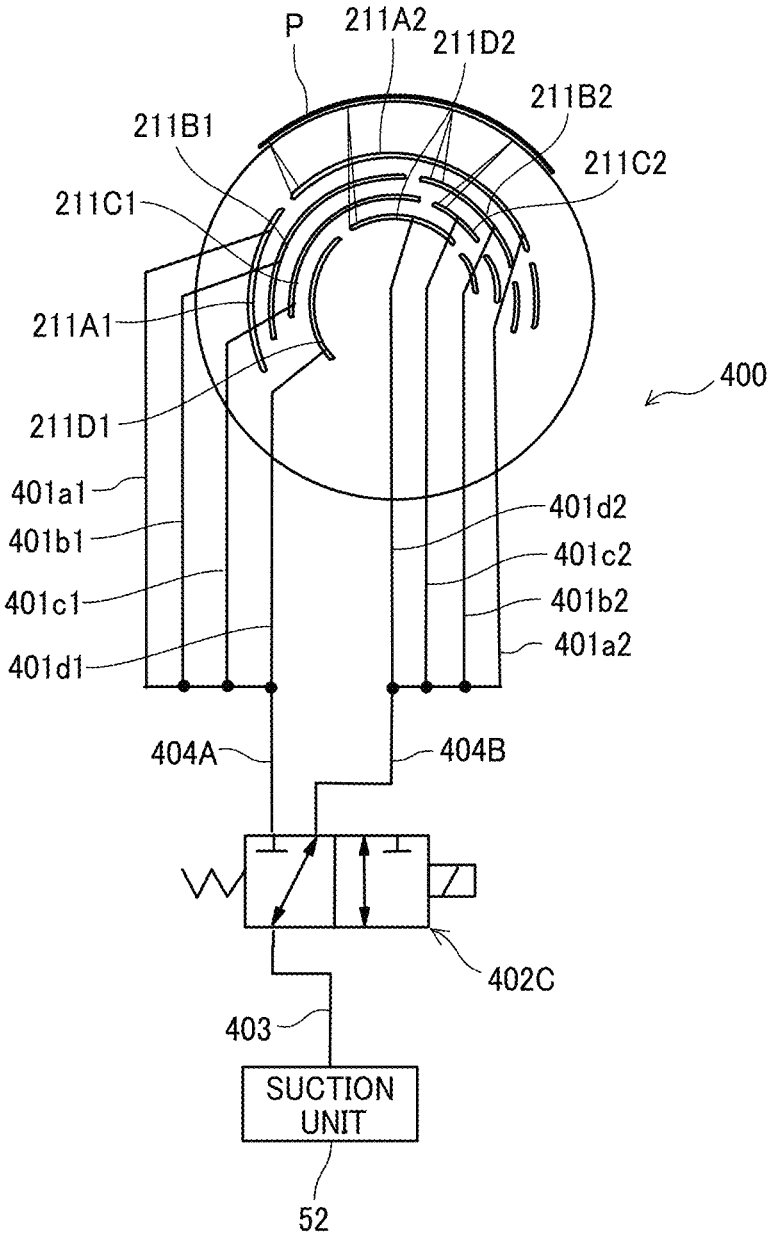
FIG. 30 is a schematic view of a switching unit that switches whether or not to suck air in the plurality of bearing areas of the drum according to a third embodiment.
Figure 31:
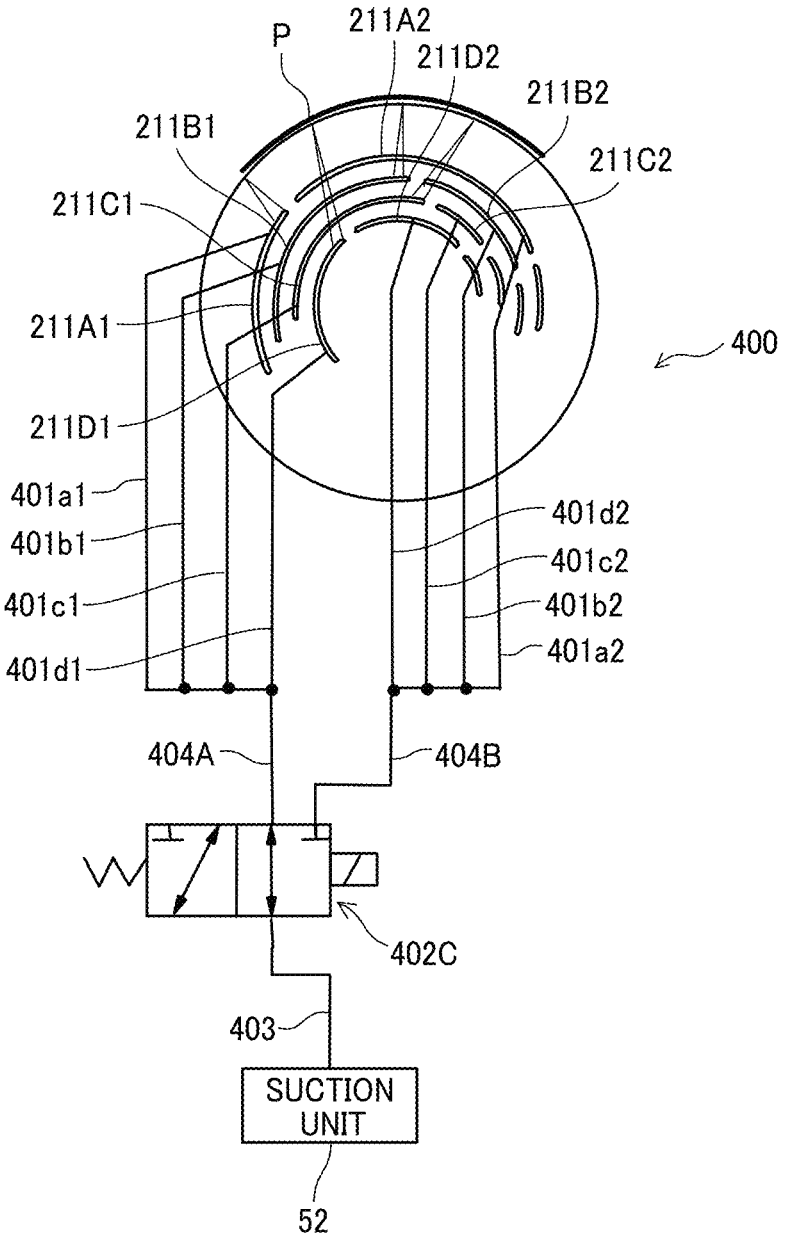
FIG. 31 is a schematic view of the switching unit in a state switched from a state illustrated in FIG. 30 according to the third embodiment.

Next, a description is given of a third embodiment of the present disclosure with reference to FIGS. 30 and 31. FIGS. 30 and 31 are schematic views of a switching unit 400 that switches whether or not to suck air in the plurality of bearing areas 105 of the drum 51 according to the third embodiment.

In the present embodiment, the individual paths 401*a*1 to 401*d*1 are collectively connected to the divided common path 404A, and the individual paths 401*a*2 to 401*d*2 are collectively connected to the divided common path 404B. Further, the divided common paths 404A and 404B are collectively connected to the common path 403. A three-way valve 402C is disposed between the divided common paths 404A and 404B and the common path 403.

In FIG. 30, the three-way valve 402C disables the suction via the grooves 211A1 to 211D1 and enables the suction via the grooves 211A2 to 211D2, thereby bearing the sheet P. When the drum 51 rotates and the sheet P reaches the position illustrated in FIG. 31, as illustrated in FIG. 31, the three-way valve 402C is switched to enable the suction via the grooves 211A1 to 211D1 and disable the suction via the grooves 211A2 to 211D2. With this configuration, foreign substances such as mist can be prevented from being sucked by disabling the suction in the areas on which the sheet P is not borne, and the number of valves 402 can be reduced.

Figure 32:
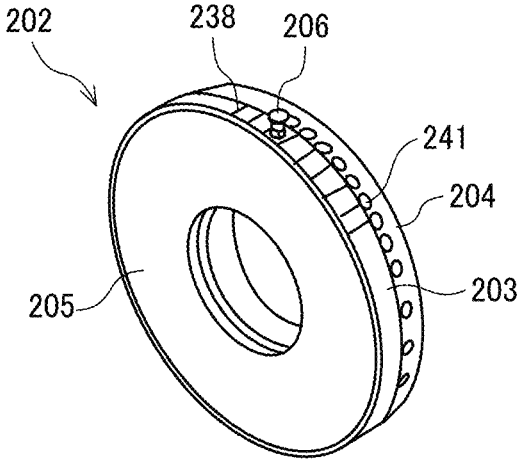
FIG. 32 is a perspective view of a rotational portion of the rotary valve for explaining switching operation by the first member.
Figure 33:
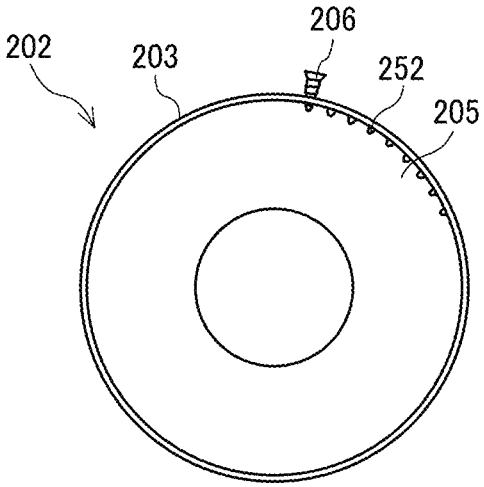
FIG. 33 is a side view of the rotational portion.
Figure 34:
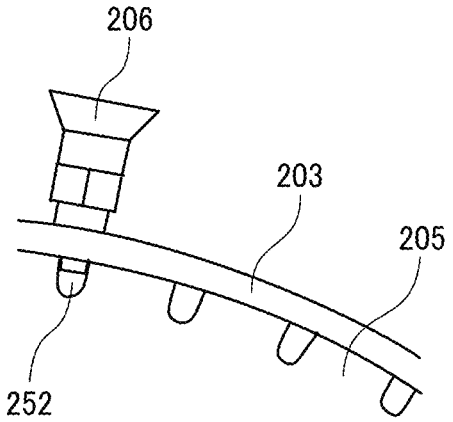
FIG. 34 is an enlarged side view of a part of the rotational portion.
Figure 35:
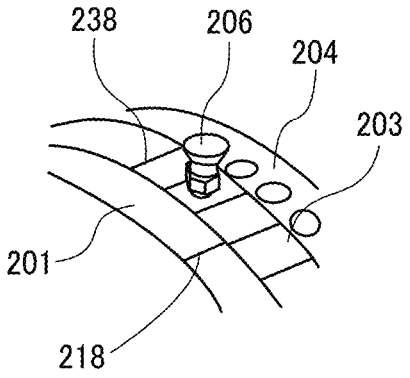
FIG. 35 is an enlarged perspective view of a part of the rotary valve.

Next, the switching operation by the first member 203 is described with reference to FIGS. 32 to 35. FIG. 32 is a perspective view of the rotational portion 202 of the rotary valve 200. FIG. 33 is a side view of the rotational portion 202. FIG. 34 is an enlarged side view of apart of the rotational portion 202. FIG. 35 is an enlarged perspective view of apart of the rotary valve 200. In the present embodiment, the first member 203 can be manually rotated by a user. The user manually rotates the first member 203 to switch the suction area. The rotation operation of the first member 203 (i.e., suction area switching operation) uses an index plunger 206. The tip of the index plunger 206 fits into a hole 252 formed on the circumferential surface of the third member 205 according to each position, thereby positioning the first member 203. When performing the rotation operation of the first member 203, the user pulls out the index plunger 206 from the hole 252 and rotates the first member 203 relative to the second member 204 and the third member 205 to the target position. At the target position, the user inserts the tip of the index plunger 206 into another hole 252.

In order to recognize the setting state of the first member 203, for example, the nine-step scale 238 is attached to the circumferential surface of the first member 203 to indicate the rotation position of the first member 203. Further, as illustrated in FIG. 35, a mark 218 as a reference for the scale 238 of the first member 203 can be provided on the circumferential surface of the stationary portion 201. When the size of the sheet P is switched, for example, in a sheet size switching mode, the drum 51 is set at a predetermined phase so that the user can access the index plunger 206. Further, the drum 51 is secured at the predetermined position so that the drum 51 is not rotated when the user operates the index plunger 206.

Figure 36:
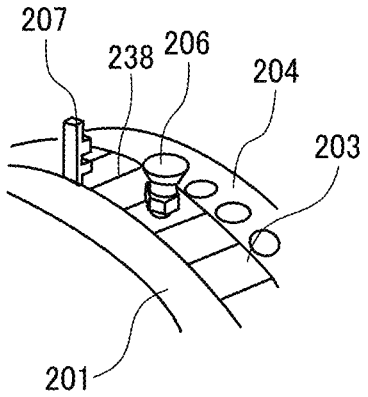
FIG. 36 is an enlarged perspective view of a part of the rotary valve for explaining acquisition of size data in the suction area.

Next, a description is given of data acquisition of the size of the suction area with reference to FIG. 36. FIG. 36 is a perspective view of a part of the rotary valve 200 for explaining the data acquisition. A photo sensor 207 is attached to the stationary portion 201 that does not rotate together with the drum 51, and the first member 203 is provided with a detection piece (feeler) detected by the photo sensor 207. With this configuration, since the first member 203 rotates together with the drum 51, the photo sensor 207 detects the feeler and generates one pulse each time the drum 51 makes one rotation. When the same mechanism is provided on the drum 51, a total of two pulses are detected during one rotation of the drum 51, one by the feeler provided on the drum 51 and one by the feeler provided on the first member 203.

Since the first member 203 has a phase difference with the second member 204 that rotates together with the drum 51, the rotation angle of the first member 203 can be detected by measuring the interval between the two pulses generated by the drum 51 and the first member 203 rotating at a constant speed. As a result, the relative phase difference between the first member 203 and the second member 204, that is, the setting data of the suction area can be acquired.

Figure 37:
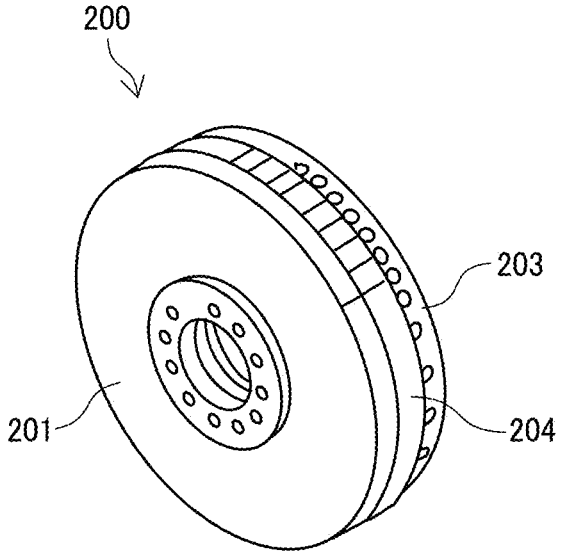
FIG. 37 is an exterior perspective view of the rotary valve according to a fourth embodiment of the present disclosure.
Figure 38:
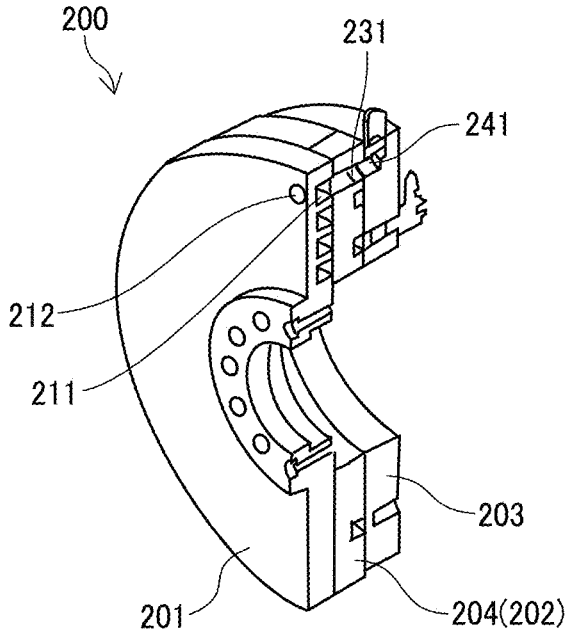
FIG. 38 is a cross-sectional perspective view of the rotary valve according to the fourth embodiment.
Figure 39:
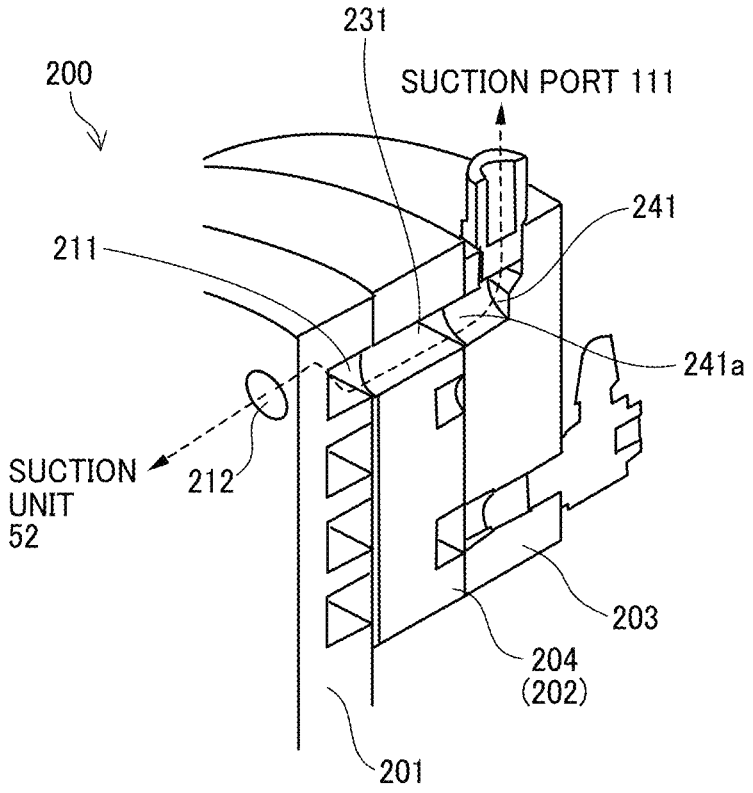
FIG. 39 is an enlarged cross-sectional perspective view of a part of the rotary valve according to the fourth embodiment.
Figure 40A:
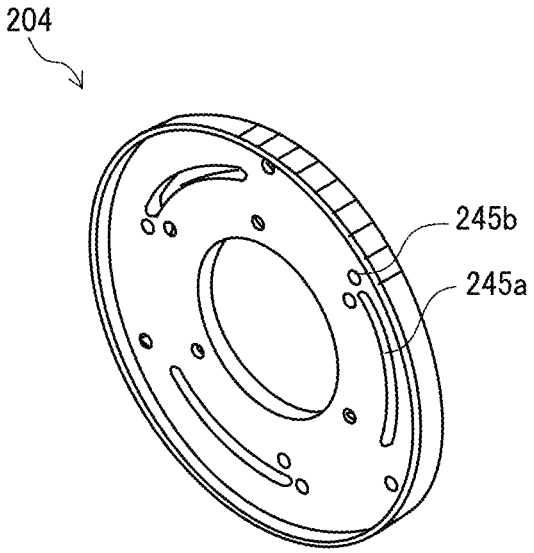
FIGS. 40A and 40B are perspective views of the second member included in the rotary valve according to the fourth embodiment.
Figure 40B:
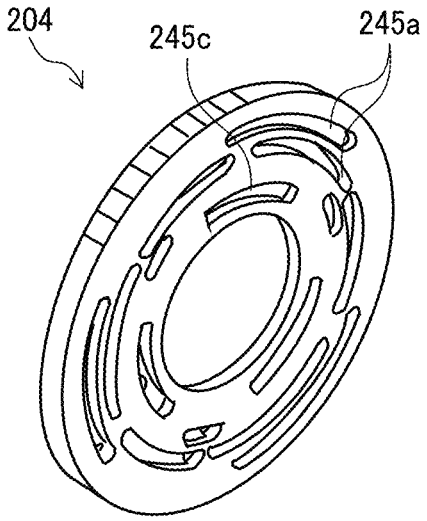
Figure 41:
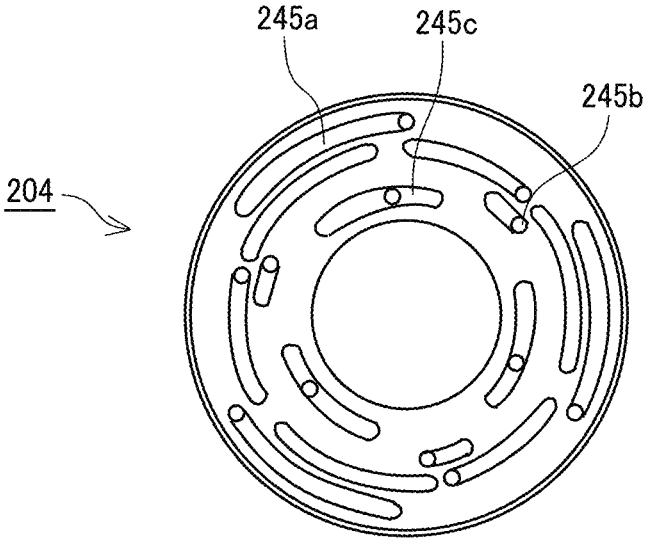
FIG. 41 is a side view of the second member according to the fourth embodiment.

Next, a fourth embodiment of the present disclosure is described with reference to FIGS. 37 to 41. FIG. 37 is an exterior perspective view of the rotary valve 200. FIG. 38 is a cross-sectional perspective view of the rotary valve 200. FIG. 39 is an enlarged cross-sectional perspective view of a part of the rotary valve 200. FIGS. 40A and 40B are perspective views of the second member 204 included in the rotary valve 200. FIG. 41 is a side view of the second member 204. The second member 204 in the fourth embodiment is the member that combines the first member 203 and the third member 205 in the first embodiment, and the first member 203 in the fourth embodiment is the second member 204 in the first embodiment.

In the fourth embodiment, as illustrated in FIGS. 40A to 40C, the second member 204 has through grooves 245*a* extending along the circumferential direction, through holes 245*b*, grooves 245*c* having a bottom on the side surface of the disk-shape, corresponding to each bearing area 105. The through grooves 245*a*, the through holes 245*b*, and the grooves 245*c* are arranged at four locations on the concentric circles from the outer circumference toward the center in the radial direction.

Therefore, also in the present embodiment, the size of the suction area (the number of suction holes 112 communicating with the suction unit 52) is switched by rotating the first member 203 relative to the second member 204.

In this case, the second member 204 rotates together with the drum 51. As the first member 203 rotates, the distance between the suction port 111 of the drum 51 and the connection port of the hose 56 of the rotational portion 202 of the rotary valve 200 changes. Therefore, the hoses 56 are arranged so as to be adaptable to the change of the distance.

In the above embodiments, the circumferential direction of the drum 51 is the same as the circumferential direction of the stationary portion 201 and the circumferential direction of the rotational portion 202, and the same applies to the axial direction and the radial direction.

As described above, according to the present disclosure, suction of foreign substances such as mist in the suction areas on which a sheet is not borne can be reduced.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A sheet suction device comprising:

a sheet bearer configured to bear a plurality of sheets on a plurality of bearing areas of a circumferential surface of the sheet bearer and rotate, the sheet bearer having a plurality of suction holes on the plurality of bearing areas;

a rotational portion configured to rotate in a same cycle of the sheet bearer, the rotational portion having a plurality of holes that are connectable to the plurality of suction holes;

a suction unit configured to suck air via the plurality of holes of the rotational portion; and a switching unit configured to switch combinations of whether or not to suck the air among the plurality of bearing areas of the sheet bearer according to a phase of rotation of one of the sheet bearer and the rotational portion, wherein the switching unit includes a stationary portion having a plurality of grooves divided in a circumferential direction of the stationary portion, the plurality of grooves configured to switch connection between the suction unit and the plurality of holes of the rotational portion.

2. The sheet suction device according to claim 1, wherein the switching unit includes a valve configured to open and close between the stationary portion and the suction unit.

3. The sheet suction device according to claim 1, wherein the stationary portion has a plurality of rows of the plurality of grooves in a radial direction of the stationary portion.

4. The sheet suction device according to claim 2, wherein the valve includes a common valve that is common to grooves belonging to different rows of the plurality of rows.

5. The sheet suction device according to claim 1, wherein the switching unit is configured to switch whether or not to suck the air in the plurality of bearing areas of the sheet bearer in units of each of the plurality of sheets.

6. The sheet suction device according to claim 1, wherein the rotational portion includes:

a first member having grooves arranged in a circumferential direction of the rotational portion, the grooves configured to communicate with the suction unit; and a second member having the plurality of holes arranged in the circumferential direction, wherein, when the first member rotates with respect to the second member, the number of holes communicating with the grooves among the plurality of holes is changed to change the number of the plurality of suction holes communicating with the suction unit.

7. The sheet suction device according to claim 6, wherein the plurality of suction holes is arranged in a circumferential direction of the sheet bearer, and wherein, when the first member rotates, the number of the plurality of suction holes communicating with the suction unit is changed in the circumferential direction.

8. The sheet suction device according to claim 6, wherein the plurality of suction holes is arranged in an axial direction of the sheet bearer, and wherein, when the first member rotates, the number of the plurality of suction holes communicating with the suction unit is changed in the axial direction.

9. A sheet conveyor comprising:

the sheet suction device according to claim 1, wherein the sheet bearer is configured to rotate to convey the plurality of sheets.

10. A printer comprising:

the sheet conveyor according to claim 9; and an image forming unit configured to form an image on the plurality of sheets.

11. A suction area switching device between a plurality of suction holes on a plurality of bearing areas of a circumferential surface of a sheet bearer to bear a sheet on the circumferential surface and a suction unit to suck air through the plurality of suction holes, the suction area switching device comprising:

a rotational portion configured to rotate in a same cycle of the sheet bearer, the rotational portion having a plurality of holes that is connectable to the plurality of suction holes; and a switching unit configured to switch combinations of whether or not to suck the air among the plurality of bearing areas of the sheet bearer according to a phase of rotation of one of the sheet bearer and the rotational portion, wherein the switching unit includes a stationary portion having a plurality of grooves divided in a circumferential direction of the stationary portion, the plurality of grooves configured to switch connection between the suction unit and the plurality of holes of the rotational portion.

* * * * *